US006834721B2

(12) United States Patent
Suro

(10) Patent No.: US 6,834,721 B2
(45) Date of Patent: Dec. 28, 2004

(54) SYSTEM FOR DISCONNECTING COILED TUBING

(75) Inventor: Christian Suro, Sommieres (FR)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/045,497

(22) Filed: Jan. 14, 2002

(65) Prior Publication Data

US 2003/0132004 A1 Jul. 17, 2003

(51) Int. Cl.[7] ..... E21B 29/12

(52) U.S. Cl. ..... 166/297; 166/55; 166/77.51; 166/340; 166/361

(58) Field of Search ..... 166/55, 77.2, 77.51, 166/85.1, 297, 298, 340, 361, 376, 377

(56) References Cited

U.S. PATENT DOCUMENTS

| | | | | |
|---|---|---|---|---|
| 3,590,920 A | * | 7/1971 | Orund et al. | 166/55 |
| 5,002,130 A | * | 3/1991 | Laky | 166/351 |
| 5,284,209 A | * | 2/1994 | Godfrey | 166/380 |
| 5,400,857 A | * | 3/1995 | Whitby et al. | 166/297 |
| 5,551,665 A | | 9/1996 | Noack et al. | 251/58 |
| 5,727,640 A | * | 3/1998 | Gleditsch | 175/7 |
| 6,131,953 A | | 10/2000 | Connell et al. | 285/3 |
| 6,269,883 B1 | | 8/2001 | Gissler et al. | 166/340 |
| 6,349,767 B2 | | 2/2002 | Gissler | 166/242.6 |
| 6,386,290 B1 | * | 5/2002 | Headworth | 166/346 |

OTHER PUBLICATIONS

Paper entitled "First Boat–Based CT Operations In The North Sea" by Poul Starck, dated 1998.

Article entitled "Elf Gabon speeds workover with special vessel", Oil & Gas Journal Report, dated Apr. 27, 1987, pp. 37–38.

* cited by examiner

*Primary Examiner*—Zakiya Walker
(74) *Attorney, Agent, or Firm*—John W. Wustenberg; Warren B. Kice

(57) ABSTRACT

A disconnect system for coiled tubing. A first end of the coiled tubing is disconnected from a second end of the coiled tubing by holding the coiled tubing in a stationary position at a first and a second location. The coiled tubing is then sheared at one or more locations between the first and the second location.

34 Claims, 28 Drawing Sheets

30545.10/HES-2001-IP-004498/4499/4511

SYSTEM FOR DISCONNECTING COILED TUBING

BACKGROUND

This invention relates generally to oil and gas wells, and in particular to systems for controlling coiled tubing for oil and gas wells.

During the operation of an oil and gas well, coiled tubing is frequently positioned in the well to perform tasks such as, for example, sand cleanout of the well, plugging the well with cement, acidizing the formation, operating equipment within the well, and well intervention operations. During the operation of offshore oil and gas wells, the use of coiled tubing to perform such tasks can create significant safety hazards to equipment and personnel in the event of a well malfunction. For example, if the operating pressures within the well become excessive, the operating pressure within the coiled tubing may also be excessive. If the coiled tubing must be disconnected during such a situation in order to prevent a catastrophic accident, the free end of the coiled tubing may tend to whip around the area proximate the offshore platform. As a result, the free end of the coiled tubing may impact with the offshore platform and the personnel in the area. Furthermore, the contents of the free end of the coiled tubing may be released to the atmosphere and could be sprayed on personnel and equipment a considerable distance from the point at which the coiled tubing was cut. The contents of the coiled tubing could also be highly flammable and/or toxic to personnel. Conventional systems for disconnecting coiled tubing on offshore platforms do not prevent or minimize such hazards when the coiled tubing is disconnected.

The present invention is directed to overcoming one or more of the limitations of existing systems for disconnecting coiled tubing.

DESCRIPTION OF THE PREFERRED EMBODIMENTS

Figure 1A:
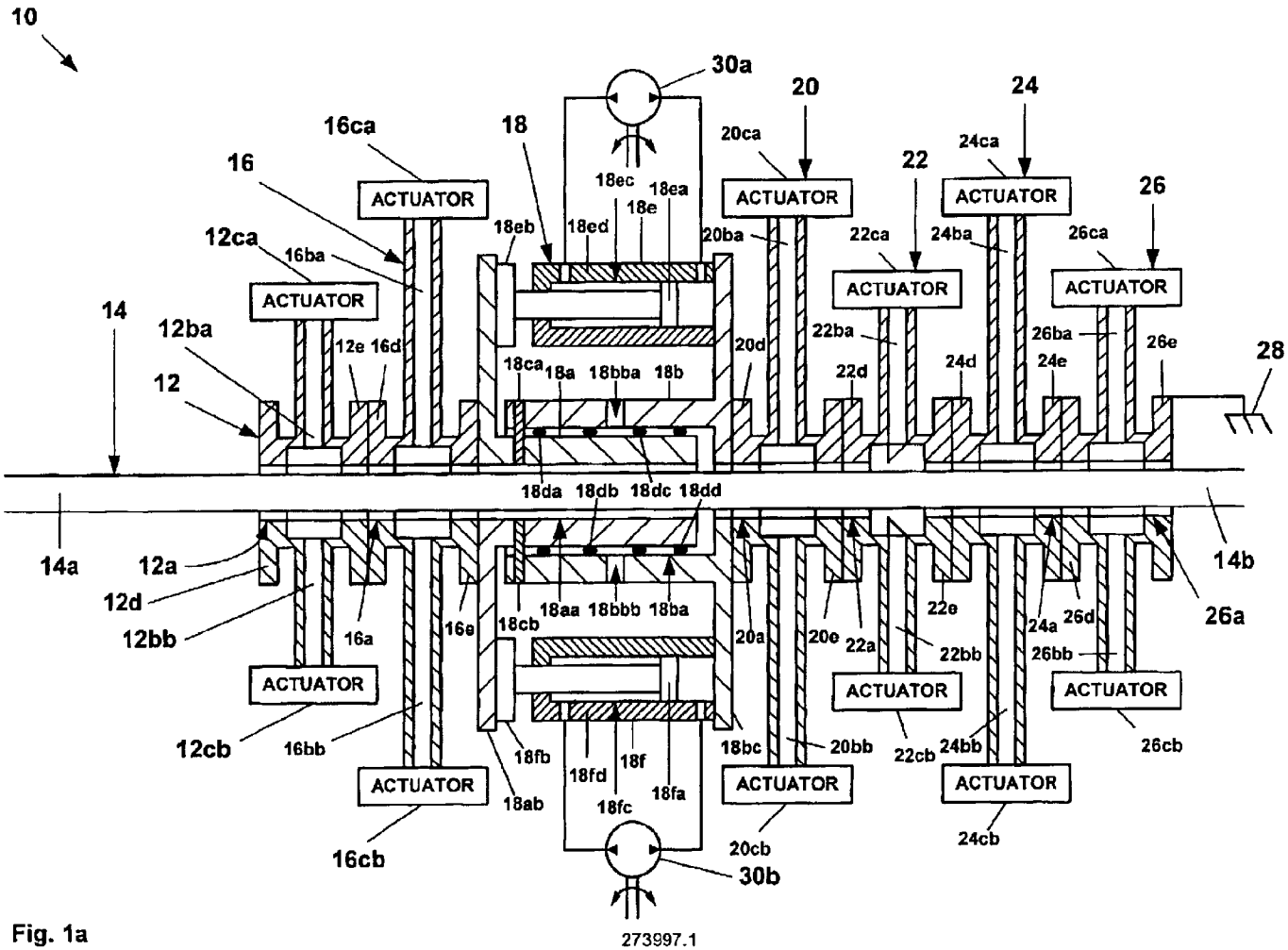
FIG. 1*a* is an illustration of an embodiment of a system for disconnecting coiled tubing in an initial state.

Referring to FIG. 1*a*, the reference numeral 10 refers, in general, to an embodiment of a disconnect system for coiled tubing that includes a conventional slip ram assembly 12 that defines a passage 12*a* for receiving coiled tubing 14 that includes slip rams, 12*ba* and 12*bb*, and corresponding actuators, 12*ca* and 12*cb*, for actuating the slip rams to controllably engage the coiled tubing 14 and a pair of flanges, 12*d* and 12*e*, at opposite ends of the slip ram assembly 12. A conventional pipe ram assembly 16 is provided that defines a passage 16*a* for receiving the coiled tubing 14 and includes pipe rams, 16*ba* and 16*bb*, and corresponding actuators, 16*ca* and 16*cb*, for actuating the pipe rams to controllably engage the coiled tubing 14, a flange 16*d* at one end that is coupled to the flange 12*e* of the slip ram, and a flange 16*e* at another end. The combination of the slip ram assembly 12 and the pipe ram assembly 16 may be provided as a conventional single blow out preventor (BOP) assembly commercially available from Halliburton Energy Services, Inc.

An actuator assembly 18 is provided that includes an inner sleeve 18*a* that defines a passage 18*aa* for receiving the coiled tubing 14 and a flange 18*ab* at one end that is coupled to the flange 16*e* of the pipe ram assembly 16. An outer sleeve 18*b* defines a passage 18*ba* for receiving the inner sleeve 18*a* and radial vent passages, 18*bba* and 18*bbb*, and includes a flange 18*bc* at one end. Shear pins, 18*ca* and 18*cb*, releasably couple the inner and outer sleeves, 18*a* and 18*b*, together in a stationary relationship and sealing members, 18*da*, 18*db*, 18*dc*, and 18*dd*, are coupled to the inner sleeve 18*a* for sealing the interface between the inner and outer sleeves, 18*a* and 18*b*, respectively. Hydraulic actuators, 18*e* and 18*f*, include pistons, 18*ea* and 18*fa*, respectively, that include flanges, 18*eb* and 18*fb*, at one end that are coupled to the flange 18*ab*. The pistons, 18*ea* and 18*fa*, are movably received within piston chambers, 18*ec* and 18*fc*, respectively, that are defined within cylinders, 18*ed* and 18*fd*, respectively, that are coupled at one end to the flange 18*bc*.

A conventional blind ram assembly 20 is provided that defines a passage 20*a* for receiving the coiled tubing 14 and includes blind rams, 20*ba* and 20*bb*, and corresponding actuators, 20*ca* and 20*cb*, for actuating the blind rams to controllably close off the passage 20*a*, a flange 20*d* at one end that is coupled to the flange 18*bc* of the actuator assembly 18, and a flange 20*e* at another end. A conventional shear ram assembly 22 is provided that defines a passage 22*a* for receiving the coiled tubing 14 and includes shear rams, 22*ba* and 22*bb*, and corresponding actuators, 22*ca* and 22*cb*, for actuating the shear ram to controllably shear the coiled tubing 14, a flange 22*d* at one end that is coupled to the flange 20*e* of the blind ram assembly 20, and a flange 22*e* at another end. A conventional pipe ram assembly 24 is provided that defines a passage 24*a* for receiving the coiled tubing 14 and includes pipe rams, 24*ba* and 24*bb*, and corresponding actuators, 24*ca* and 24*cb*, for actuating the pipe rams to controllably engage the coiled tubing 14, a flange 24*d* at one end that is coupled to the flange 22*e* of the shear ram assembly 22, and a flange 24*e* at another end. A conventional slip ram assembly 26 is provided that defines a passage 26*a* for receiving the coiled tubing 14 and includes slip rams, 26*ba* and 26*bb*, and corresponding actuators, 26*ca* and 26*cb*, for actuating the slip rams to controllably engage the coiled tubing 14, a flange 26*d* at one end that is coupled to the flange 24*e* of the pipe ram assembly 24, and a flange 26*e* at another end that is coupled to an offshore platform 28. The combination of the blind ram assembly 20, the shear ram assembly 22, the pipe ram assembly 24, and the slip ram assembly 26 may be provided as a conventional quad BOP assembly commercially available from Halliburton Energy Services, Inc.

An end 14*a* of the coiled tubing 14 extends out of the flange 12*d* of the slip ram assembly 12 into a conventional undersea wellbore below the surface of the water, and the other end 14*b* of the coiled tubing 14 extends out of the flange 26*e* of the slip ram assembly 26 to a conventional reel of coiled tubing. In this manner, the coiled tubing 14 may be dispensed off of the reel into the undersea wellbore.

Figure 1B:
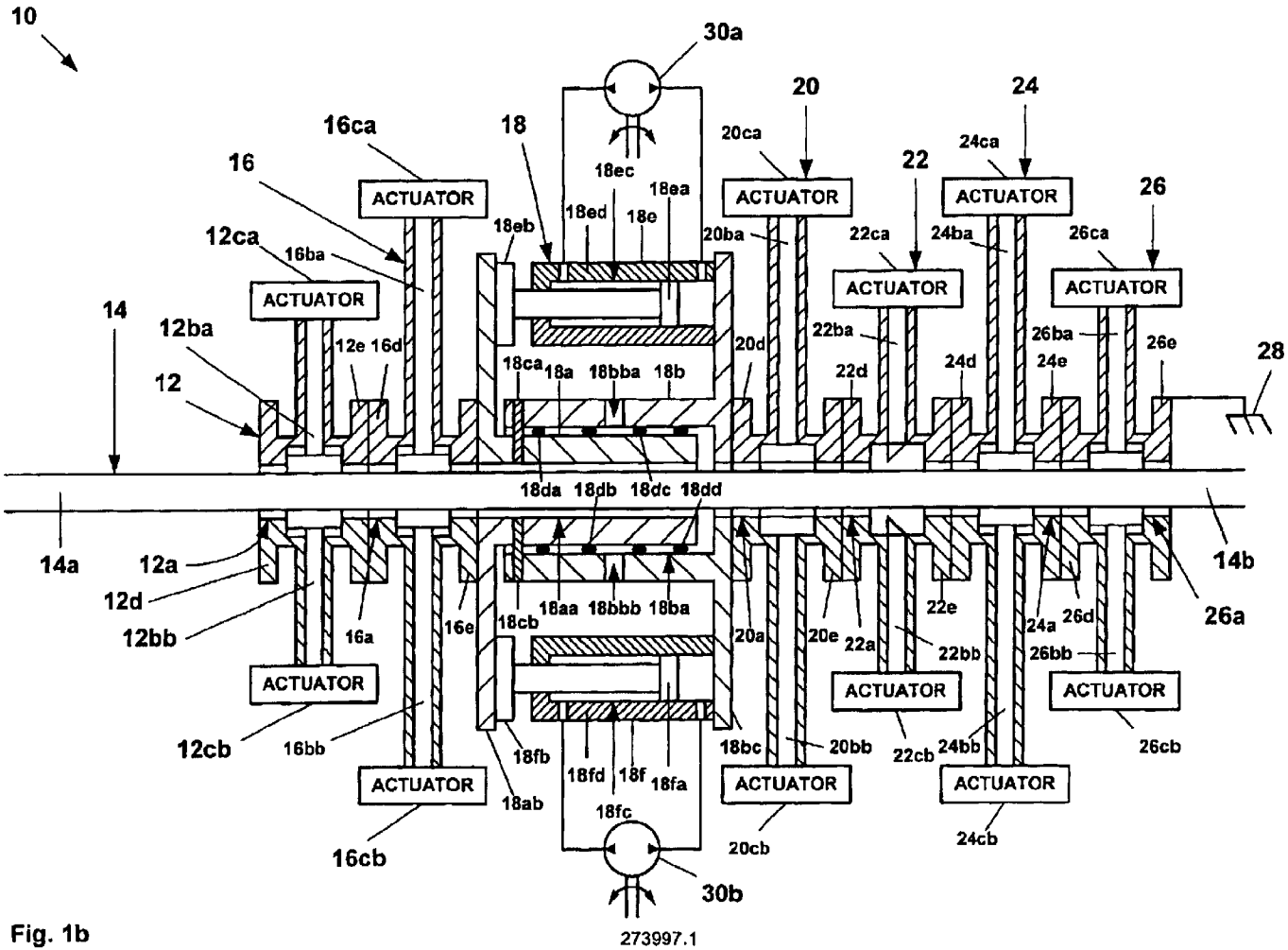
FIG. 1*b* is an illustration of the system of FIG. 1*a* after closing the pipe and the slip rams.

During operation, as illustrated in FIG. 1*b*, the end 14*a* of the coiled tubing 14 may be disconnected from the end 14*b* of the coiled tubing by closing the pipe rams and slip rams, 12*ba*, 12*bb*, 16*ba*, 16*bb*, 24*ba*, 24*bb*, 26*ba*, and 26*bb*, of the slip and pipe ram assemblies, 12, 16, 24, and 26. In this manner, the coiled tubing 14 is engaged by the pipe and slip rams, 12*ba*, 12*bb*, 16*ba*, 16*bb*, 24*ba*, 24*bb*, 26*ba*, and 26*bb*, and held in a stationary position within the passages 12*a*, 16*a*, 18*a*, 20*a*, 22*a*, 24*a*, and 26*a* of the disconnect system 10.

Figure 1C:
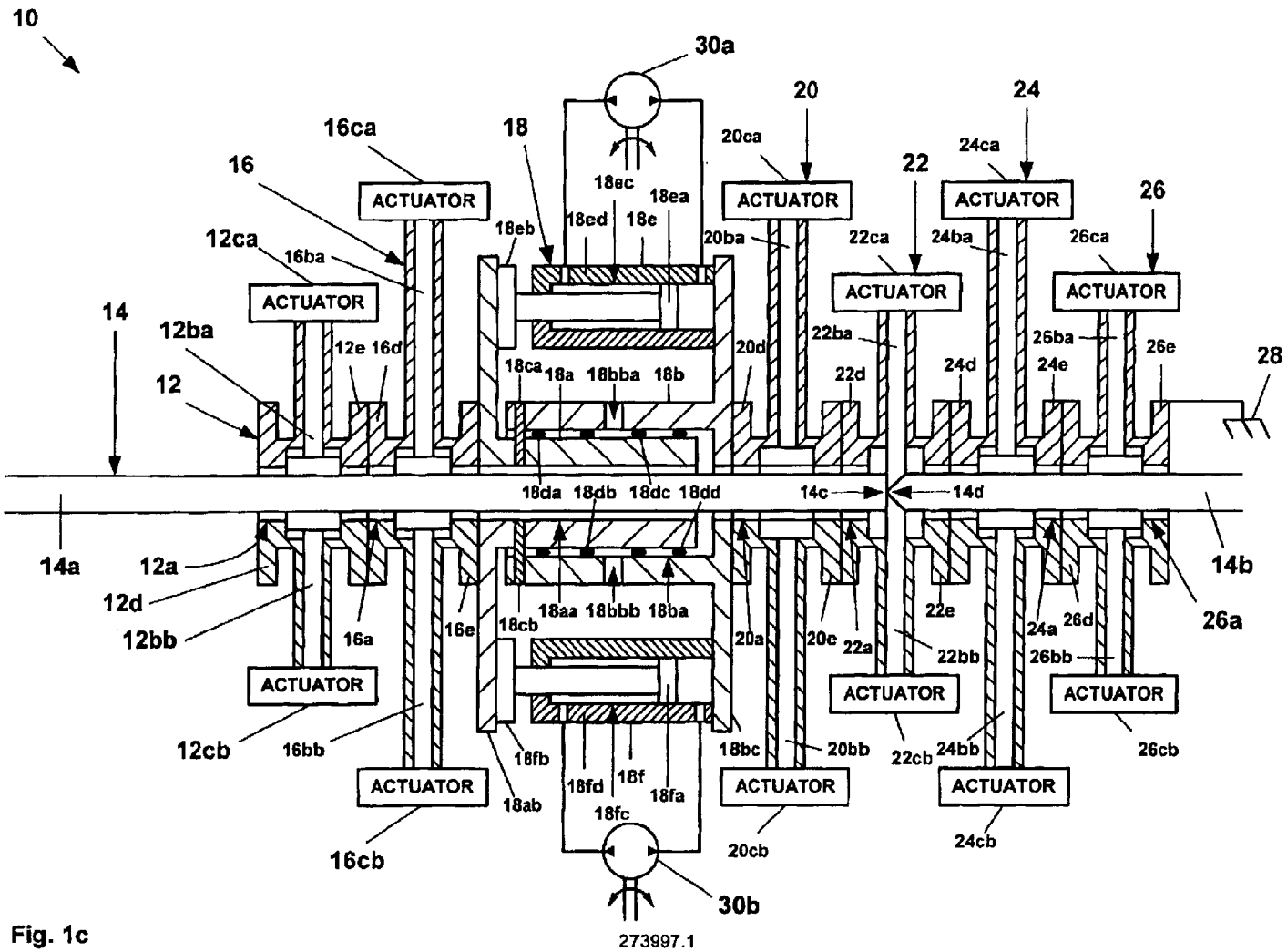
FIG. 1*c* is an illustration of the system of FIG. 1*b* after closing the shear rams to shear the coiled tubing.

As illustrated in FIG. 1*c*, the shear rams, 22*ba* and 22*bb*, of the shear ram assembly 22 are then actuated to shear the coiled tubing 14 within the passage 22*a* thereby forming sheared ends, 14*c* and 14*d*. In an exemplary embodiment, the shear rams, 22*ba* and 22*bb*, are further adapted to crimp the sheared end 14*d* of the coiled tubing 14.

Figure 1D:
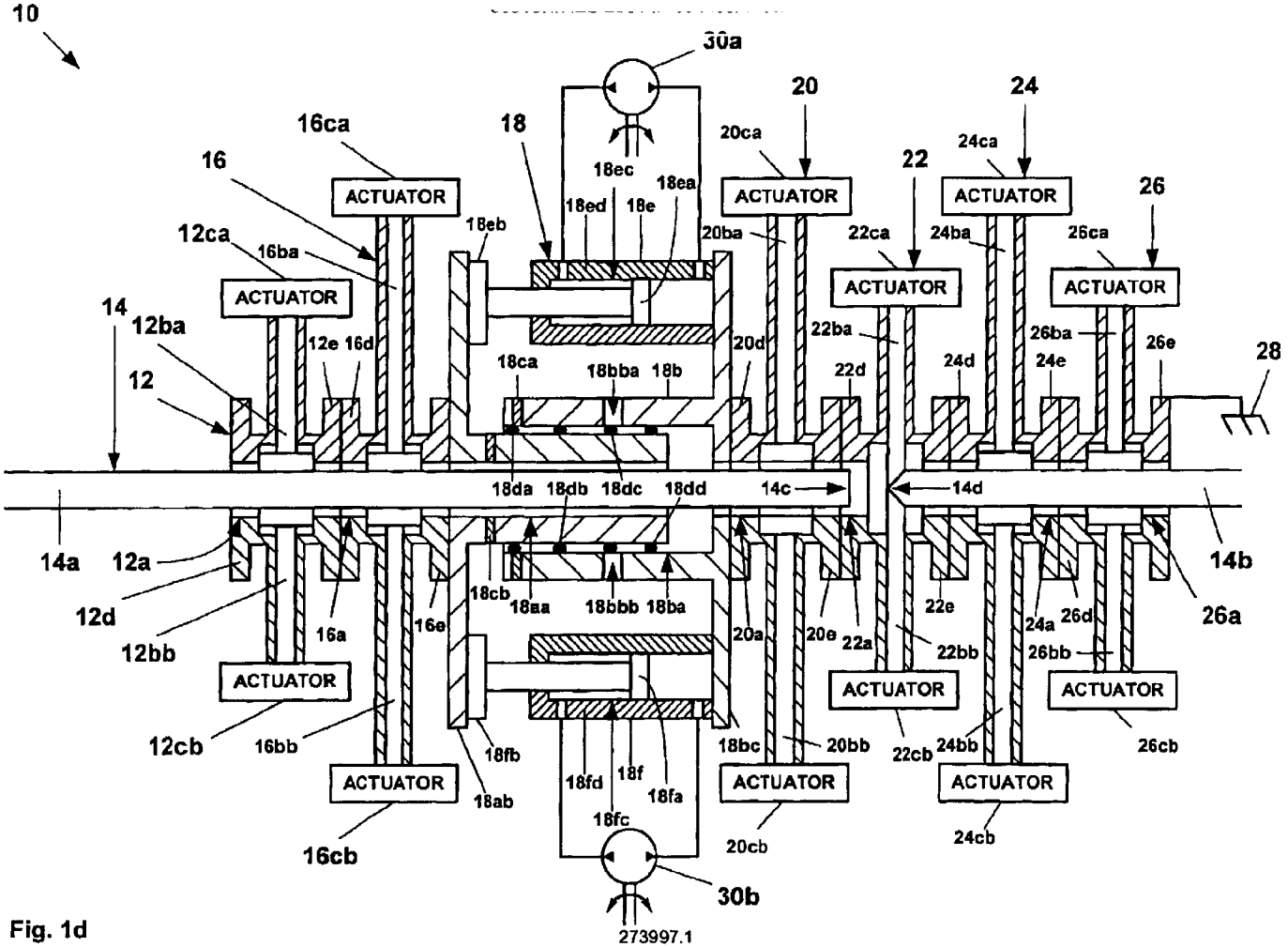
FIG. 1*d* is an illustration of the system of FIG. 1*c* after extending the actuator assembly.

As illustrated in FIG. 1*d*, the hydraulic actuators, 18*e* and 18*f*, of the actuator assembly 18 are then actuated by injecting a pressurized fluid into the piston chambers, 18*ec* and 18*fc*, using corresponding pumps, 30*a* and 30*b*. As a result, the shear pins, 18*ca* and 18*cb*, are sheared, and the pistons, 18*ea* and 18*fa*, are driven in a direction out of the piston chambers, 18*ec* and 18*fc*, thereby extending the length of the hydraulic actuators, 18*e* and 18*f*. As a result, the flanges, 18*ab* and 18*bc*, of the inner and outer sleeves, 18*a* and 18*b*, are driven away from each other thereby extending the overall length of the actuator assembly 18 and thereby moving the sheared ends, 14*c* and 14*d*, of the coiled tubing 14 away from each other.

Figure 1E:
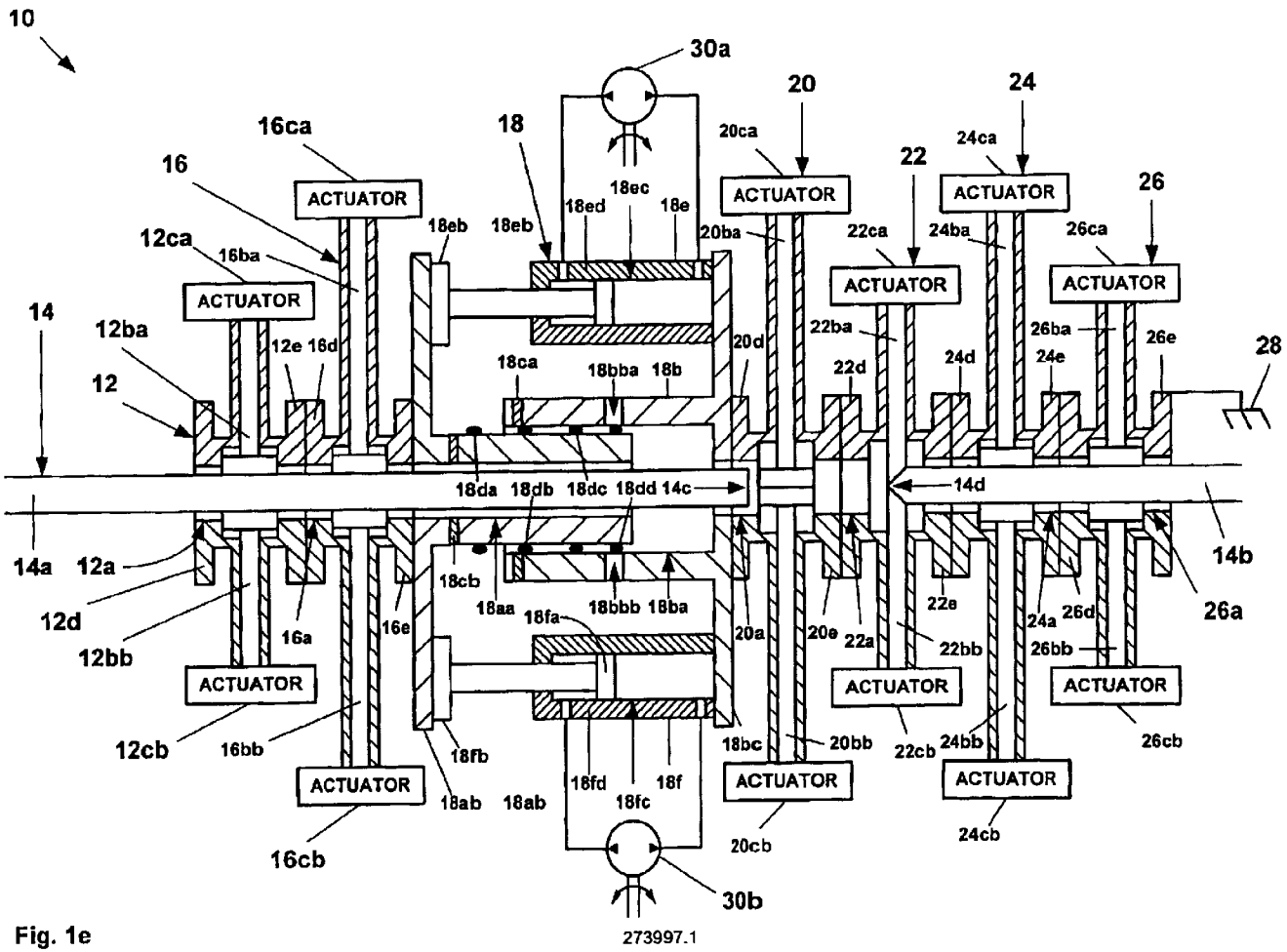
FIG. 1*e* is an illustration of the system of FIG. 1*d* after further extending the actuator and closing the blind rams.

As illustrated in FIG. 1*e*, once the sheared end 14*c* of the coiled tubing 14 has been moved beyond the blind rams, 20*ba* and 20*bb*, of the blind ram assembly 20, the blind rams are actuated to thereby close off the passage 20*a*. In this manner, the sheared ends, 14*c* and 14*d*, of the coiled tubing 14 are isolated from one another.

Figure 1F:
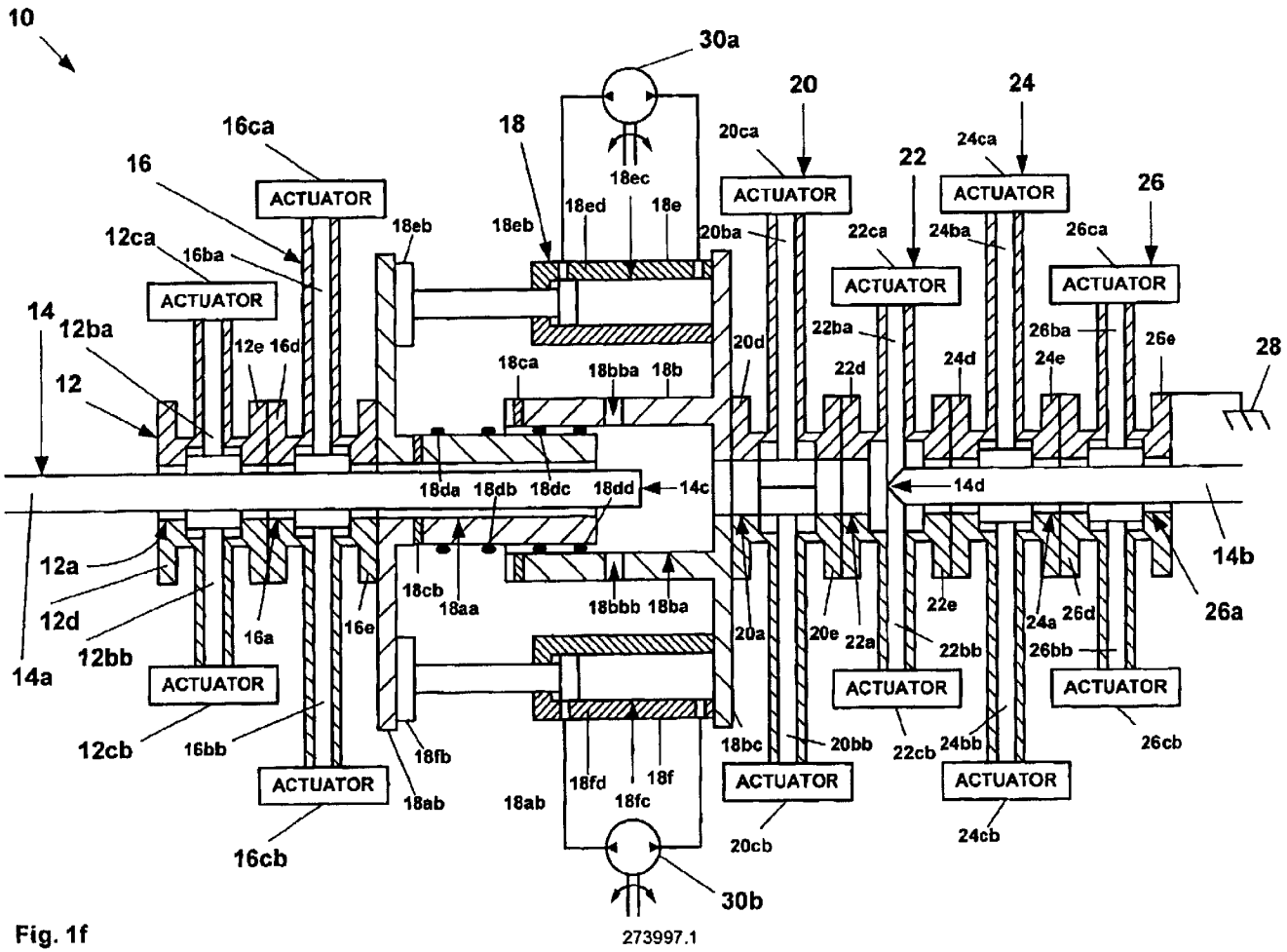
FIG. 1*f* is an illustration of the system of FIG. 1*e* after further extending the actuator assembly to bleed pressure out of an open end of the sheared coiled tubing.

As illustrated in FIG. 1*f*, the hydraulic actuators, 18*e* and 18*f*, of the actuator assembly 18 are further actuated by further injecting a pressurized fluid into the piston chambers, 18*ec* and 18*fc*. As a result, the pistons, 18*ea* and 18*fa*, are further driven in a direction out of the piston chambers, 18*ec* and 18*fc*, thereby further extending the length of the hydraulic actuators, 18*e* and 18*f*. As a result, the flanges, 18*ab* and 18*bc*, of the inner and outer sleeves, 18*a* and 18*b*, are further driven away from each other thereby further extending the overall length of the actuator assembly 18 and thereby moving the sheared ends, 14*c* and 14*d*, of the coiled tubing 14 further away from each other. Furthermore, the further relative displacement of the inner and outer sleeves, 18*a* and 18*b*, of the actuator assembly 18 exposes the radial passages, 18*bba* and 18*bbb*, thereby permitting pressurized fluids within the end 14*a* of the coiled tubing 14 to be exhausted through the sheared end 14*c* of the coiled tubing 14 out of the disconnect system 10 through the radial passages, 18*bba* and 18*bbb*. In this manner, pressurized, and possibly flammable and/or toxic, fluidic materials within the end 14*a* of the coiled tubing 14 may be controllably vented out of the coiled tubing 14.

Figure 1G:
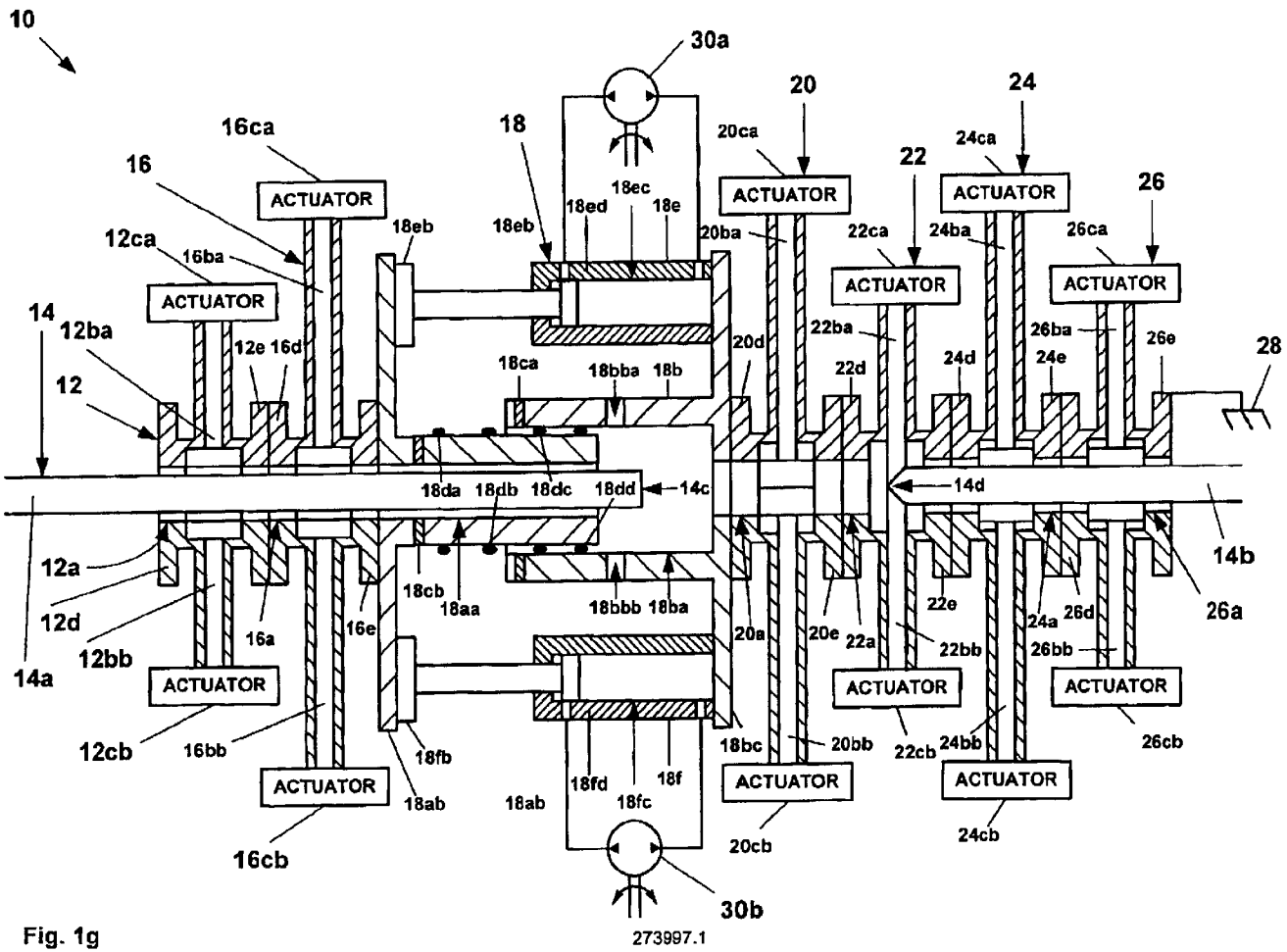
FIG. 1*g* is an illustration of the system of FIG. 1*f* after opening some of the pipe and shear rams to release a section of the sheared coiled tubing.
Figure 1H:
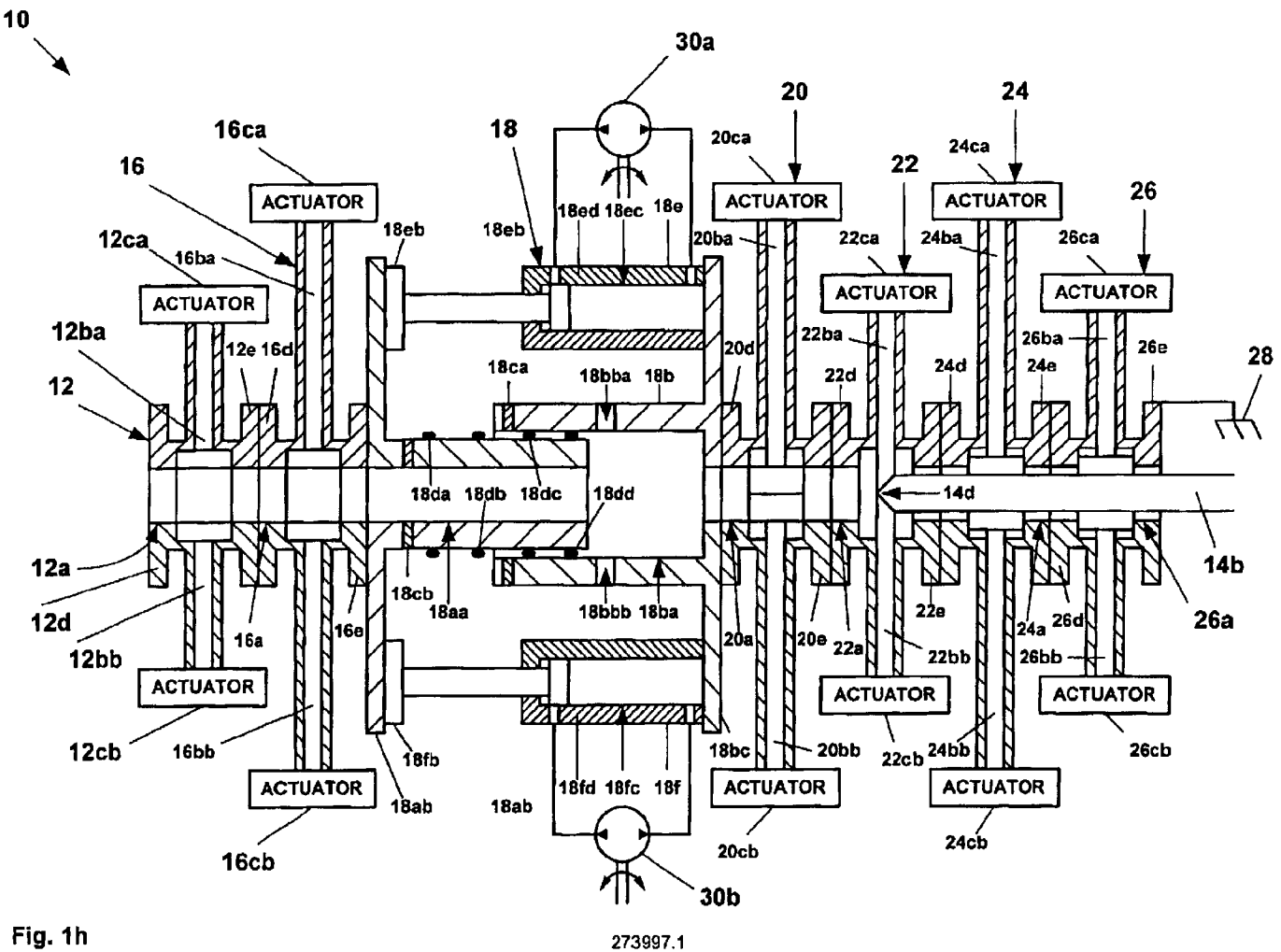
FIG. 1*h* is an illustration of the system of FIG. 1*g* after releasing an end of the sheared coiled tubing from the system.

As illustrated in FIGS. 1*g* and 1*h*, the pipe and slip rams, 12*ba*, 12*bb*, 16*ba*, and 16*bb*, of the pipe and slip ram assemblies, 12 and 16, are then actuated to release the end 14*a* of the coiled tubing 14. As a result, the de-pressurized end 14*a* of the coiled tubing 14 may now be safely dropped into the water proximate the offshore platform 28.

Thus, the disconnect system 10 provides a safe and highly efficient system for disconnecting coiled tubing 14. As a result, in the event of an emergency situation such as, for example, a blow out, the end 14*a* of the coiled tubing 14 may be quickly and safely disconnected from the end 14*b* of the coiled tubing 14 thereby preventing damage to the remaining portion of the offshore production platform 28. Furthermore, the pressurized, and possibly toxic and/or flammable, fluidic materials within the end 14*a* of the coiled tubing 14 may be controllably vented thereby minimizing potential hazards to equipment and personnel.

Figure 2A:
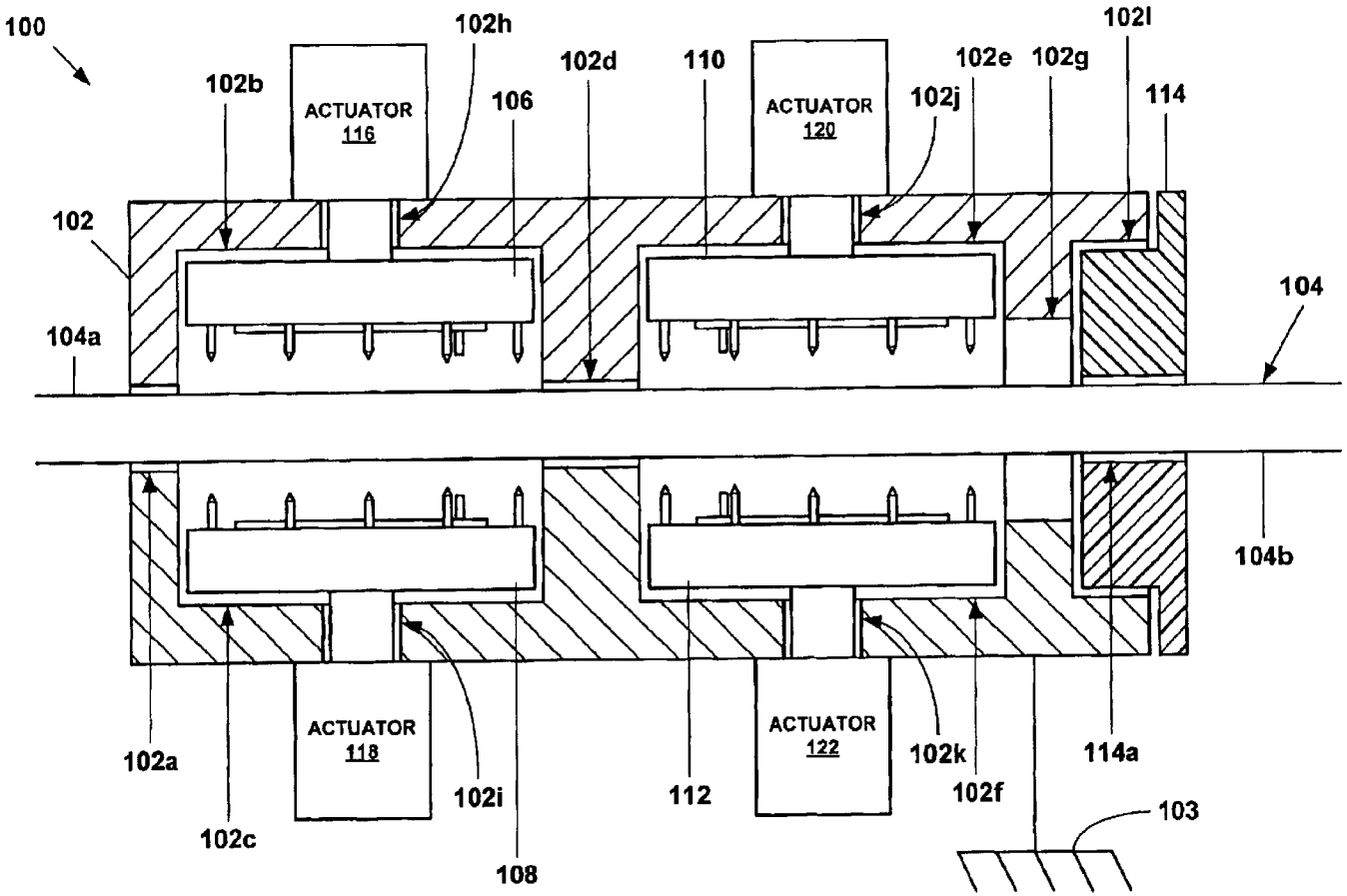
FIG. 2*a* is an illustration of another embodiment of a disconnect system for coiled tubing in an initial position.

Referring to FIG. 2*a*, the reference numeral 100 refers, in general, to another embodiment of a disconnect system for coiled tubing that includes a housing 102 that defines a passage 102*a* for receiving coiled tubing 104, a first top chamber 102*b* for receiving the coiled tubing 104 and a first top crimp and cut clamp 106, a first bottom chamber 102*c* for receiving the coiled tubing 104 and a first bottom crimp and cut clamp 108, a passage 102*d* for receiving the coiled tubing 104, a second top chamber 102*e* for receiving the coiled tubing 104 and a second top crimp and cut clamp 110, a second bottom chamber 102*f* for receiving the coiled tubing 104 and a second bottom crimp and cut clamp 112, a passage 102*g* for receiving the coiled tubing 104, passages 102*h*, 102*i*, 102*j*, and 102*k*, and a passage 102*l* for receiving the coiled tubing 104 and a tubular floatation device 114 defining a passage 114*a* for receiving the coiled tubing 104. In an exemplary embodiment, the housing 102 is coupled to an offshore platform 103 such as, for example, the deck of a floating offshore vessel.

As illustrated in FIGS. 3*a*, 3*b*, 3*c*, 3*d*, 3*e*, and 3*f*, the first top crimp and cut clamp 106 includes a housing 106*a* that defines a first rectangular channel 106*aa* for receiving the coiled tubing 104, a recess 106*ab*, a recess 106*ac*, a recess 106*ad*, a recess 106*ae*, a recess 106*af*, a semi-circular channel 106*ag* for receiving the coiled tubing 104, and a plurality of circular openings 106*aha*–106*ahl*, and includes a plurality of guide pins 106*aia*–106*aij*, a shear blade 106*aj* for shearing the coiled tubing 104, and a support member 106*ak*. Gaskets, 106*ba* and 106*bb*, are coupled to the top surface of the housing 106*a*, and a pipe ram 106*c* is supported within the recess 106*ab* of the housing 106*a* between ends of the gaskets, 106*ba* and 106*bb*, proximate the rectangular channel 106*aa*. A slip ram 106*d* is supported within the recess 106*ac* of the housing 106*a* between the pipe ram 106*c* and the recess 106*ad*, and a crimp and gripper pad 106*e* is supported within the recess 106*ae* of the housing 106*a* between the recess 106*ad* and the shear blade 106*aj*. A blind ram 106*f* is supported within the recess 106*af* of the housing 106*a* between the other ends of the rubber gaskets, 106*ba* and 106*bb*, and between the shear blade 106*aj* and the semi-circular channel 106*ag*.

As illustrated in FIGS. 4*a*, 4*b*, 4*c*, 4*d*, 4*e*, and 4*f*, the first bottom crimp and cut clamp 108 includes a housing 108*a* that defines a first rectangular channel 108*aa* for receiving the coiled tubing 104, a recess 108*ab*, a recess 108*ac*, a recess 108*ad*, a recess 108*ae*, a recess 108*af*, a semi-circular channel 108*ag* for receiving the coiled tubing 104, and a plurality of circular openings 108*aha*–108*ahj* for mating with the guide pins 106*aia*–106*aij* of the first top crimp and cut clamp 106, and includes a plurality of guide pins 108*aia*–108*ail* for mating with the circular openings 106*aha*–106*ahl* of the first top crimp and cut clamp 106, a shear blade 108*aj* for mating with the shear blade 106*aj* of the first top crimp and cut clamp 106 and thereby shearing the coiled tubing 104, and a support member 108*ak*. Gaskets, 108*ba* and 108*bb*, are coupled to the top surface of the housing 108*a*, and a pipe ram 108*c* is supported within the recess 108*ab* of the housing 108*a* between ends of the gaskets, 108*ba* and 108*bb*, proximate the rectangular channel 108*aa*. A slip ram 108*d* is supported within the recess 108*ac* of the housing 108*a* between the pipe ram 108*c* and the recess 108*ad*, and a crimp and gripper pad 108*e* is supported within the recess 108*ae* of the housing 108*a* between the recess 108*ad* and the shear blade 108*aj*. A blind ram 108*f* is supported within the recess 108*af* of the housing 108*a* between the other ends of the gaskets, 108*ba* and 108*bb*, and between the shear blade 108*aj* and the semi-circular channel 106*ag*.

The support members, 106*ak* and 108*ak*, of the first top and bottom crimp and cut clamps, 106 and 108, respectively, are operably coupled to actuators, 116 and 118, respectively, for controllably displacing the first top and bottom crimp and cut clamps, 106 and 108, respectively, toward the coiled tubing 104. In this manner, the pipe rams, 106*c* and 108*c*, and the slip rams, 106*d* and 108*d*, of the first top and bottom crimp and cut clamps, 106 and 108, may cooperatively engage the coiled tubing 104. Furthermore, in this manner, the crimp and gripper pads, 106*e* and 108*e*, and the shear blades, 106*aj* and 108*aj*, of the first top and bottom crimp and cut clamps, 106 and 108, may cooperatively grip, shear, and crimp the coiled tubing 104. Finally, the blind rams, 106*f* and 108*f*, of the first top and bottom crimp and cut clamps, 106 and 108, may cooperatively engage the coiled tubing 104.

As illustrated in FIGS. 5*a*, 5*b*, 5*c*, 5*d*, 5*e*, and 5*f*, the second top crimp and cut clamp 110 includes a housing 110*a* that defines a first rectangular channel 110*aa* for receiving the coiled tubing 104, a recess 110*ab*, a recess 110*ac*, a recess 110*ad*, a recess 110*ae*, a recess 110*af*, a semi-circular channel 110*ag* for receiving the coiled tubing 104, and a plurality of circular openings 110*aha*–110*ahl*, and includes a plurality of guide pins 110*aia*–110*aij*, a shear blade 110*aj* for shearing the coiled tubing 104, and a support member 110*ak*. Gaskets, 110*ba* and 110*bb*, are coupled to the top surface of the housing 110*a*, and a pipe ram 110*c* is supported within the recess 110*ab* of the housing 110*a* between ends of the gaskets, 110*ba* and 110*bb*, proximate the rectangular channel 110*aa*. A slip ram 110*d* is supported within the recess 110*ac* of the housing 110*a* between the pipe ram 110*c* and the recess 110*ad*, and a crimp and gripper pad 110*e* is supported within the recess 110*ae* of the housing 110*a* between the recess 110*ad* and the shear blade 110*aj*. A blind ram 110*f* is supported within the recess 110*af* of the housing 110*a* between the other ends of the rubber gaskets, 110*ba* and 110*bb*, and between the shear blade 110*aj* and the semi-circular channel 110*ag*.

As illustrated in FIGS. 6*a*, 6*b*, 6*c*, 6*d*, 6*e*, and 6*f*, the second bottom crimp and cut clamp 112 includes a housing 112*a* that defines a first rectangular channel 112*aa* for receiving the coiled tubing 104, a recess 112*ab*, a recess 112*ac*, a recess 112*ad*, a recess 112*ae*, a recess 112*af*, a semi-circular channel 112*ag* for receiving the coiled tubing 104, and a plurality of circular openings 112*aha*–112*ahj* for mating with the guide pins 110*aia*–110*aij* of the second top crimp and cut clamp 110, and includes a plurality of guide pins 112*aia*–112*ail* for mating with the circular openings 110*aha*–110*ahl* of the second top crimp and cut clamp 110, a shear blade 112*aj* for mating with the shear blade 110*aj* of the second top crimp and cut clamp 110 and thereby shearing the coiled tubing 104, and a support member 112*ak*. Gaskets, 112*ba* and 112*bb*, are coupled to the top surface of the housing 112*a*, and a pipe ram 112*c* is supported within the recess 112*ab* of the housing 112*a* between ends of the gaskets, 112*ba* and 112*bb*, proximate the rectangular channel 112*aa*. A slip ram 112*d* is supported within the recess 112*ac* of the housing 112*a* between the pipe ram 112*c* and the recess 112*ad*, and a crimp and gripper pad 112*e* is supported within the recess 112*ae* of the housing 112*a* between the recess 112*ad* and the shear blade 112*aj*. A blind ram 112*f* is supported within the recess 112*af* of the housing 112*a* between the other ends of the gaskets, 112*ba* and 112*bb*, and between the shear blade 112*aj* and the semicircular channel 110*ag*.

The support members, 110*ak* and 112*ak*, of the second top and bottom crimp and cut clamps, 110 and 112, respectively, are operably coupled to actuators, 120 and 122, respectively, for controllably displacing the second top and bottom crimp and cut clamps, 110 and 112, respectively, toward the coiled tubing 104. In this manner, the pipe rams, 110*c* and 112*c*, and the slip rams, 110*d* and 112*d*, of the second top and bottom crimp and cut clamps, 110 and 112, may cooperatively engage the coiled tubing 104. Furthermore, in this manner, the crimp and gripper pads, 110*ae* and 112*ae*, and the shear blades, 110*aj* and 112*aj*, of the second top and bottom crimp and cut clamps, 110 and 112, may cooperatively grip, shear, and crimp the coiled tubing 104. Finally, the blind rams, 110*af* and 112*af*, of the second top and bottom crimp and cut clamps, 110 and 112, may cooperatively engage the coiled tubing 104.

During initial operation of the system 100, as illustrated in FIG. 2*a*, the coiled tubing 104 passes through the passage 102*a*, the first top chamber 102*b*, the first bottom chamber 102*c*, the passage 102*d*, the second top chamber 102*e*, the second bottom chamber 102*f*, the passage 102*g*, and the passage 102*l* of the housing 102, and the passage 114*a* of the floatation device 114. An end 104*a* of the coiled tubing 104 is wound about a conventional coiled tubing reel, and the other end 104*b* of the coiled tubing may be positioned in an undersea well using a conventional coiled tubing injector.

Figure 2B:
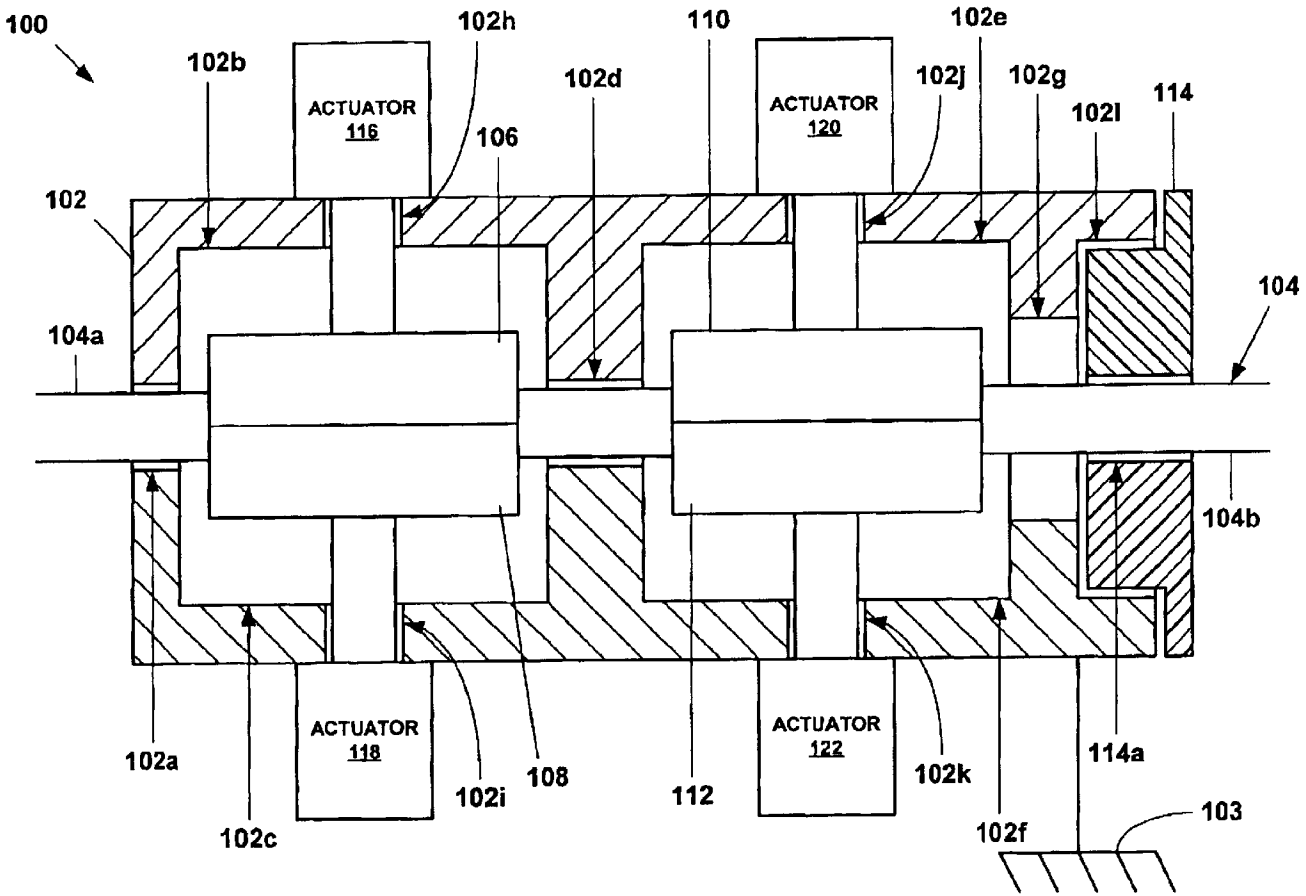
FIG. 2*b* is an illustration of the system of FIG. 2*a* after engaging, shearing, and crimping the coiled tubing.

As illustrated in FIG. 2*b*, in order to disconnect the end 104*a* of the coiled tubing 104 from the other end 104*b* of the coiled tubing 104, the first and second top and bottom crimp and cut clamps, 106, 108, 110, and 112, are actuated into engagement with the coiled tubing 104. During the engagement of the first and second top and bottom crimp and cut clamps, 106, 108, 110, and 112, with the coiled tubing 104, the pipe rams, 106*c*, 108*c* 10*c*, 112*c*, and the slip rams, 106*d*, 108*d*, 110*d* and 112*d*, cooperatively engage the coiled tubing 104 and maintain the corresponding portions of the coiled tubing 104 in a stationary position. Furthermore, during the engagement of the first and second top and bottom crimp and cut clamps, 106, 108, 110, and 112, with the coiled tubing 104, the crimp and gripper pads, 106*ae*, 108*ae*, 110*ae* and 112*ae*, and the shear blades, 106*aj*, 108*aj*, 110*aj* and 112*aj*, may cooperatively grip, shear, and crimp the corresponding portions of the coiled tubing 104. Finally, during the engagement of the first and second top and bottom crimp and cut clamps, 106, 108, 110, and 112, with the coiled tubing 104, the blind rams, 106*af*, 108*af*, 110*af* and 112*af*, may cooperatively engage the coiled tubing 104 and maintain the corresponding portions of the coiled tubing 104 in a stationary position.

Figure 2C:
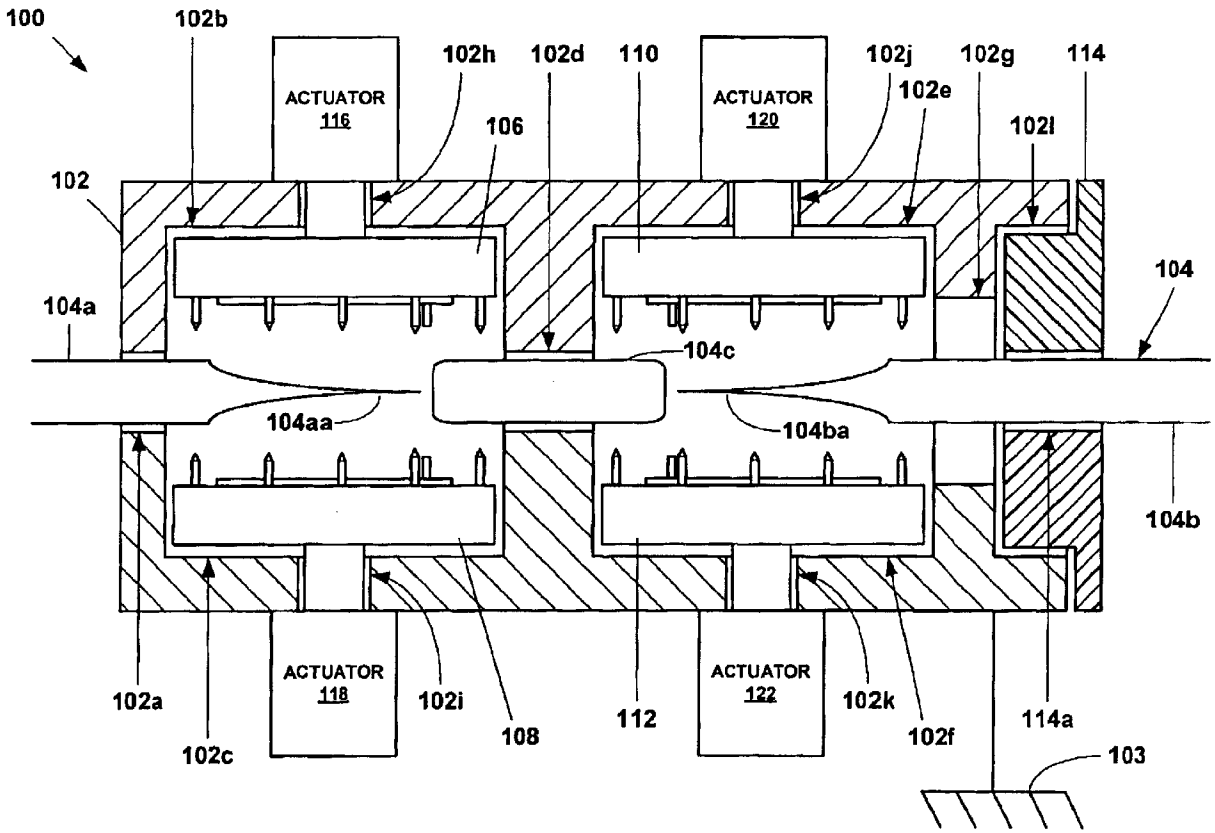
FIG. 2*c* is an illustration of the system of FIG. 2*b* after releasing the sheared and crimped ends of the coiled tubing.

As illustrated in FIG. 2*c*, the first and second top and bottom crimp and cut clamps, 106, 108, 110, and 112, are then actuated out of engagement with the coiled tubing 104. The end 104*a* of the coiled tubing 104 now includes a crimped and cut end 104*aa*, and the other end 104*b* of the coiled tubing 104 now includes a crimped and cut end 104*ba*. An intermediate free section of coiled tubing 104*c* is also formed. The outside diameter of the crimped and cut end 104*aa* of the end 104*a* of the coiled tubing 104 is greater than the inside diameter of the passages 102*a* and 102*d* of the housing 102, and the outside diameter of the crimped and cut end 104*ba* of the other end 104*b* of the coiled tubing 104 is greater than the inside diameter of the passage 114*a* of the floatation device 114. As a result, the crimped and cut end 104*aa* of the end 104*a* of the coiled tubing 104 is held within the first top and bottom chambers, 102*b* and 102*c*, thereby containing any fluidic materials within the end of the coiled tubing 104 and preventing the coiled tubing 104 from unspooling off of the coiled tubing reel. Furthermore, as a result, the crimped and cut end 104*ba* of the other end 104*b* of the coiled tubing 104 contains any pressurized, and possibly flammable and/or toxic, fluidic materials within the end of the coiled tubing 104 and the floatation device 114 is retained on the other end 104*b* of the coiled tubing 104 by the crimped and cut end 104*ba*.

Figure 2D:
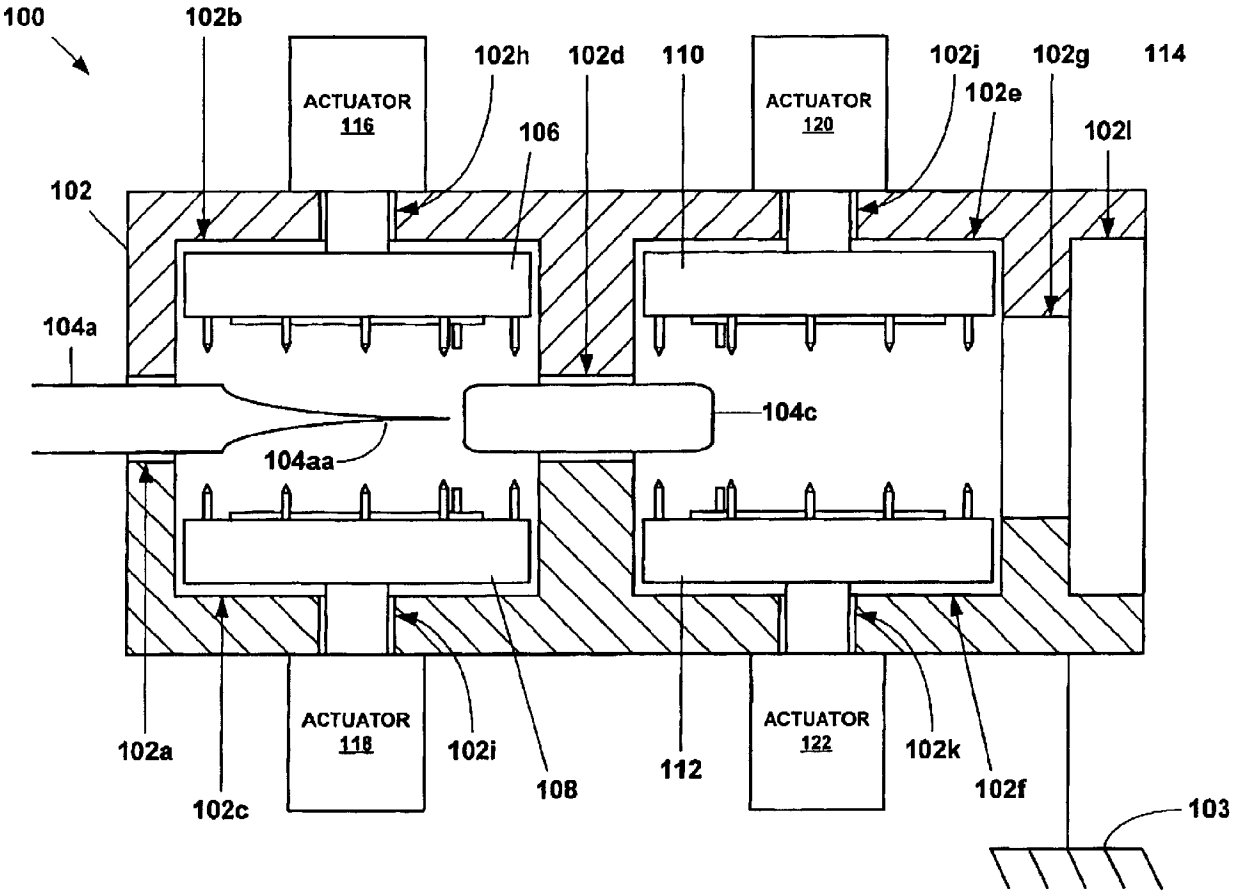
FIG. 2*d* is an illustration of the system of FIG. 2*c* after one of the released, sheared ends of the coiled tubing is released from the system into the water adjacent the offshore platform.
Figure 2E:
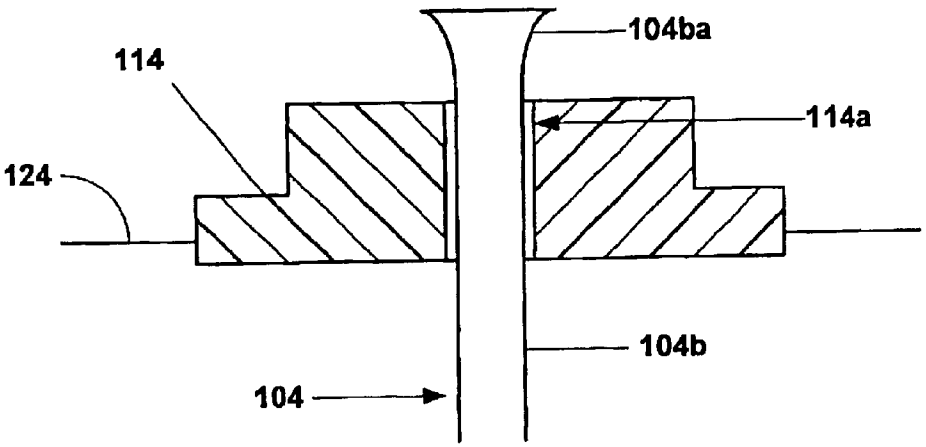
FIG. 2*e* is an illustration of the sheared end of the released end of the coiled tubing floating in the water adjacent the offshore platform.
Figure 3A:
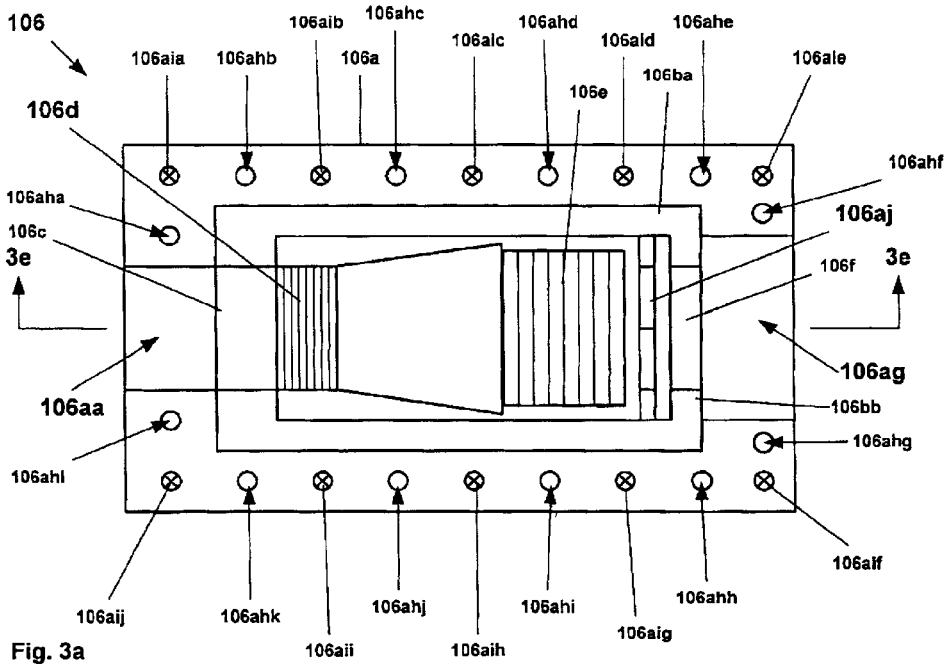
FIG. 3*a* is a top view of an embodiment of the first top crimp and cut clamp of the system of FIG. 2*a*.
Figure 3B:
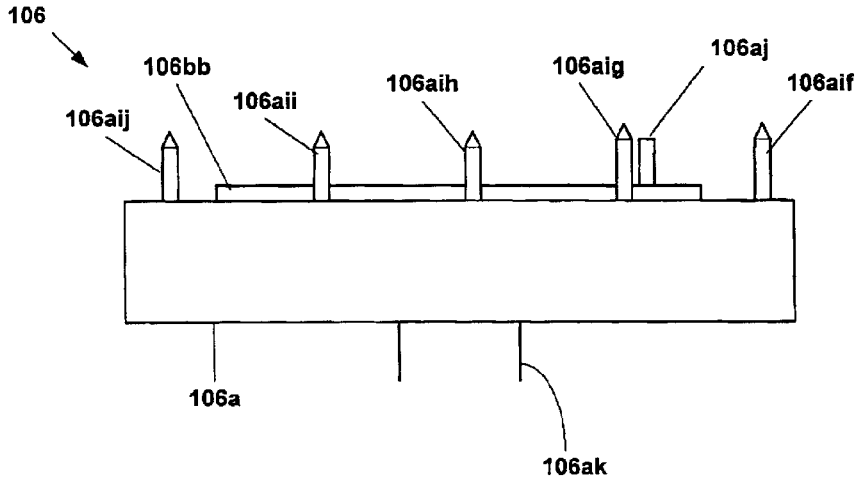
FIG. 3*b* is a side view of the first top crimp and cut clamp of FIG. 3*a*.
Figure 3C:
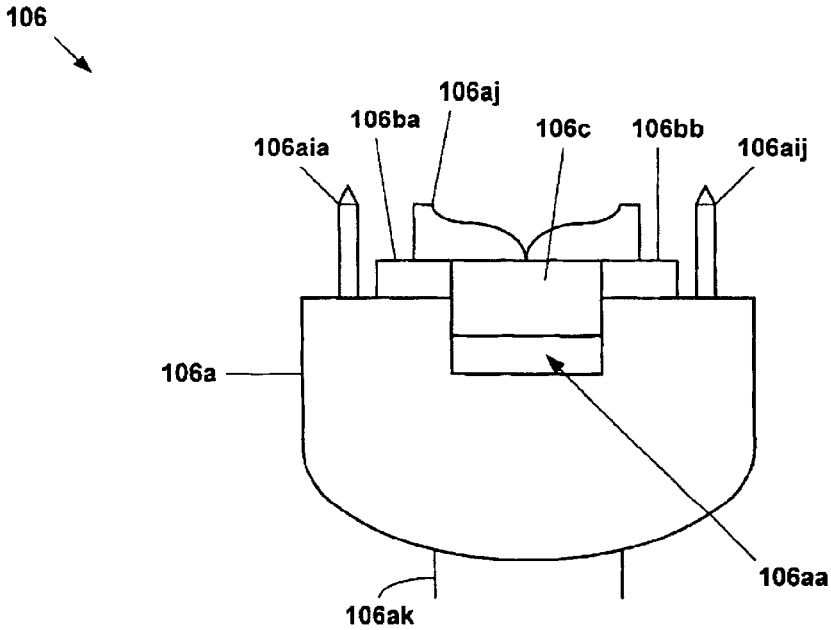
FIG. 3*c* is an end view of the first top crimp and cut clamp of FIG. 3*a*.
Figure 3D:
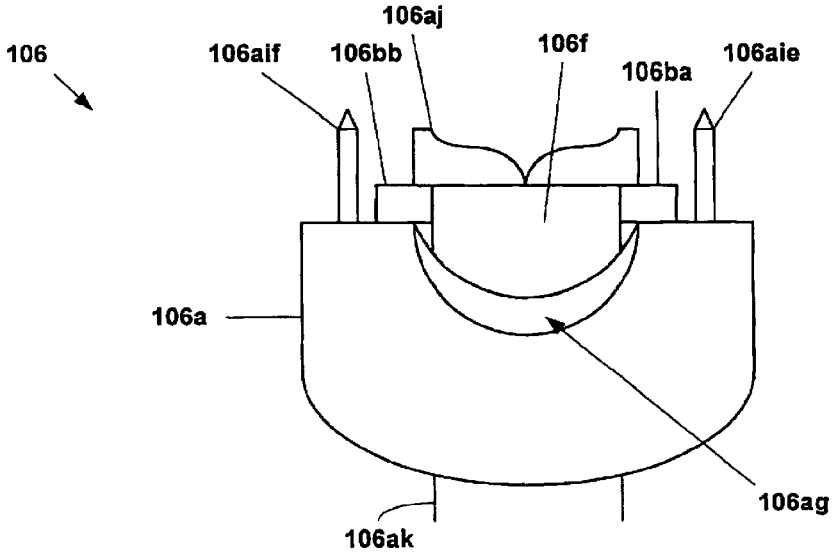
FIG. 3*d* is another end view of the first top crimp and cut clamp of FIG. 3*a*.
Figure 3E:
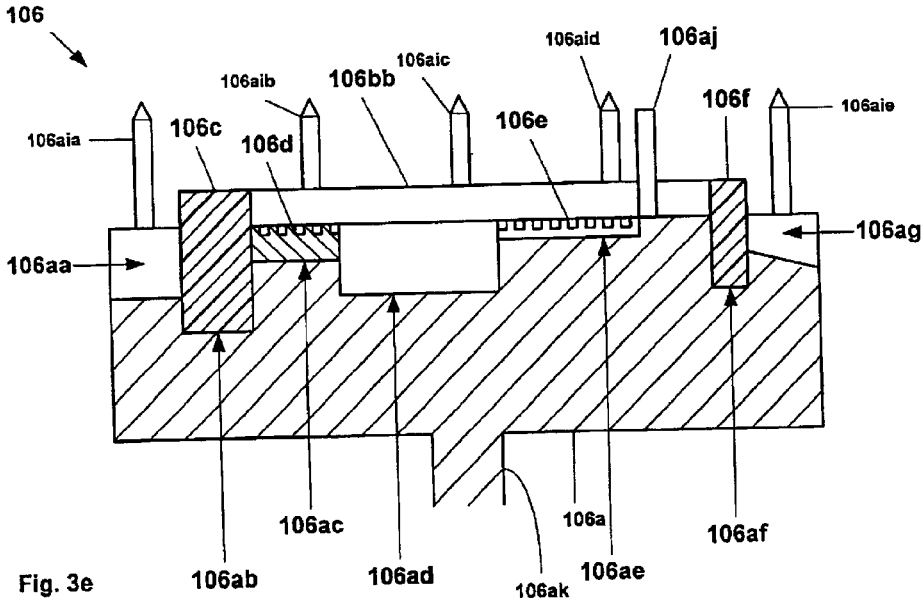
FIG. 3*e* is a cross-sectional view of the first top crimp and cut clamp of FIG. 3*a*.
Figure 3F:
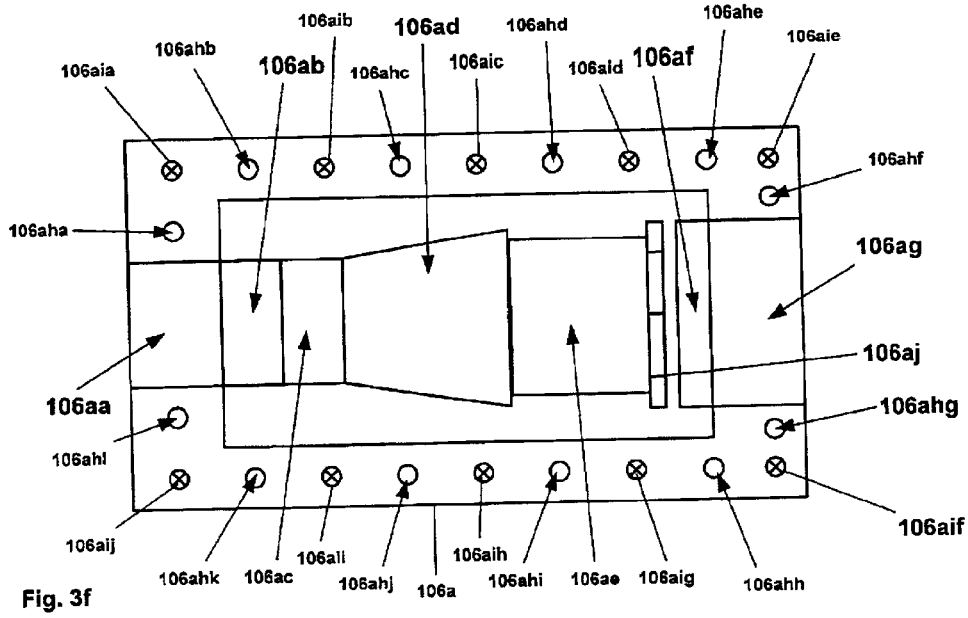
FIG. 3*f* is a top view of the housing of the first top crimp and cut clamp of FIG. 3*a*.
Figure 4A:
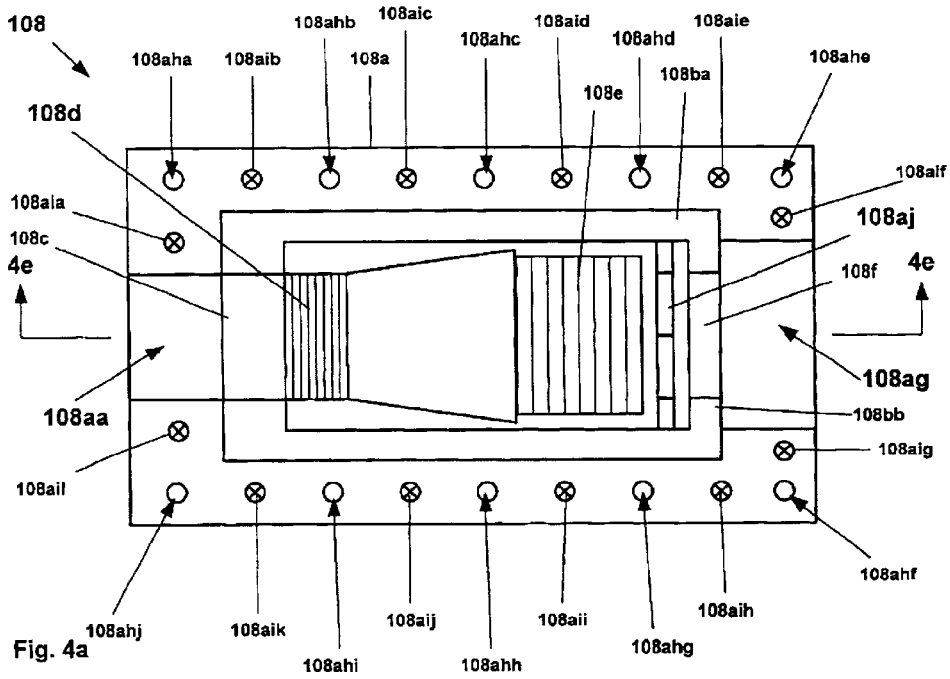
FIG. 4*a* is a top view of an embodiment of the first bottom crimp and cut clamp of the system of FIG. 2*a*.
Figure 4B:
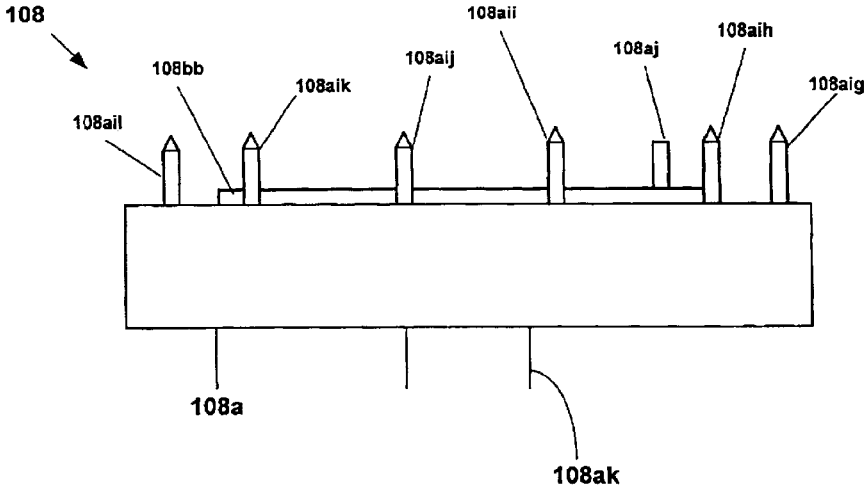
FIG. 4*b* is a side view of the first bottom crimp and cut clamp of FIG. 4*a*.
Figure 4C:
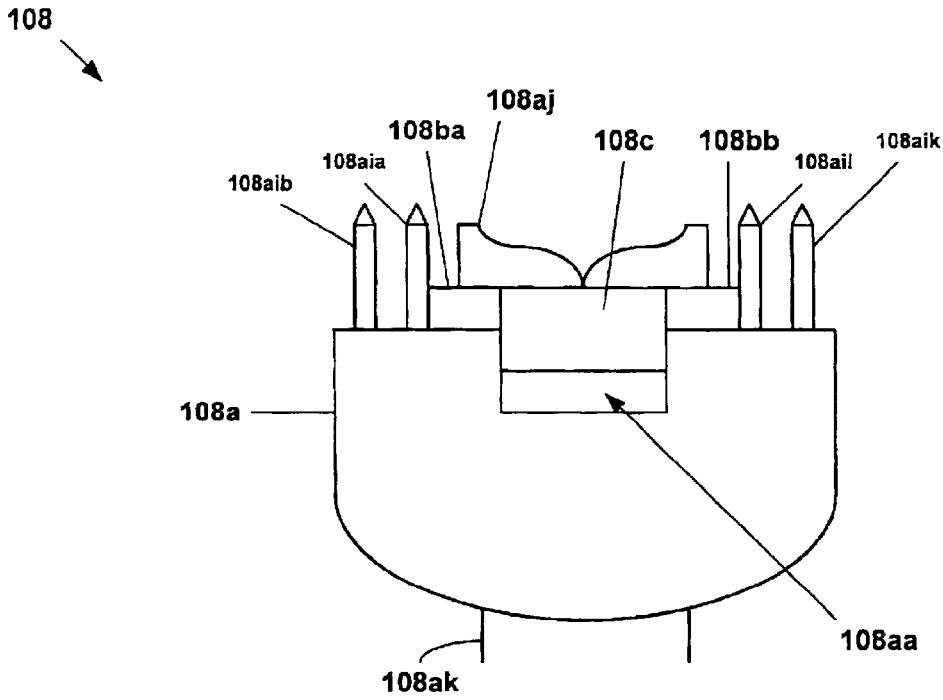
FIG. 4*c* is an end view of the first bottom crimp and cut clamp of FIG. 4*a*.
Figure 4D:
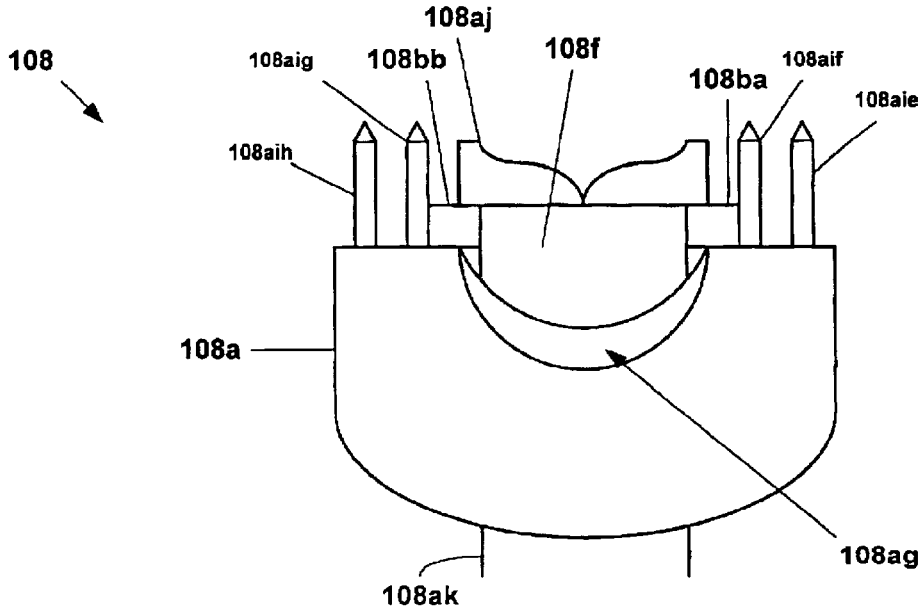
FIG. 4*d* is another end view of the first bottom crimp and cut clamp of FIG. 4*a*.
Figure 4E:
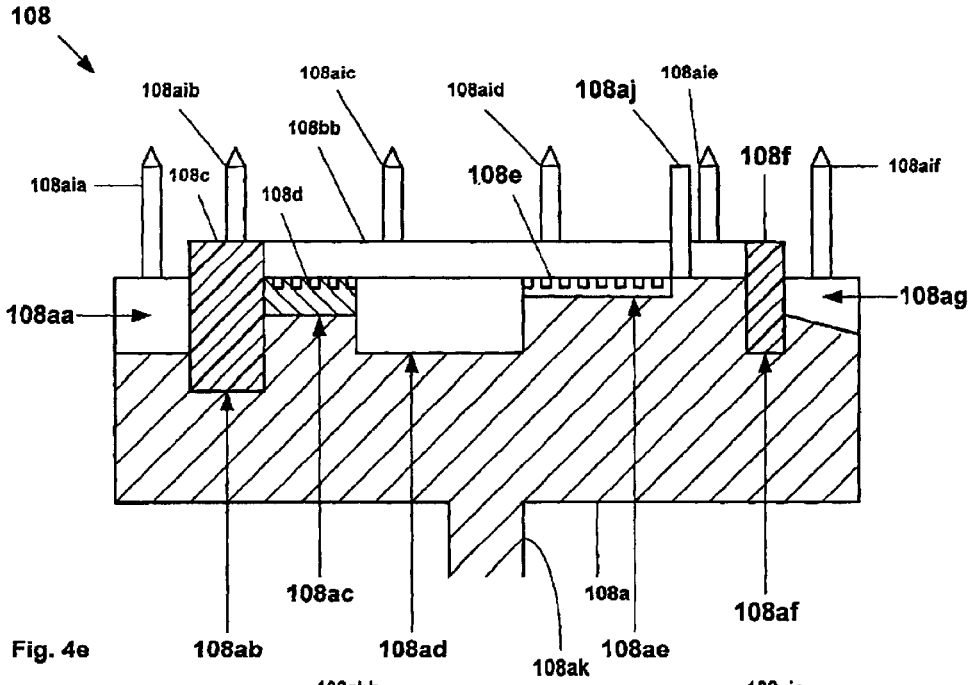
FIG. 4*e* is a cross-sectional view of the first bottom crimp and cut clamp of FIG. 4*a*.
Figure 4F:
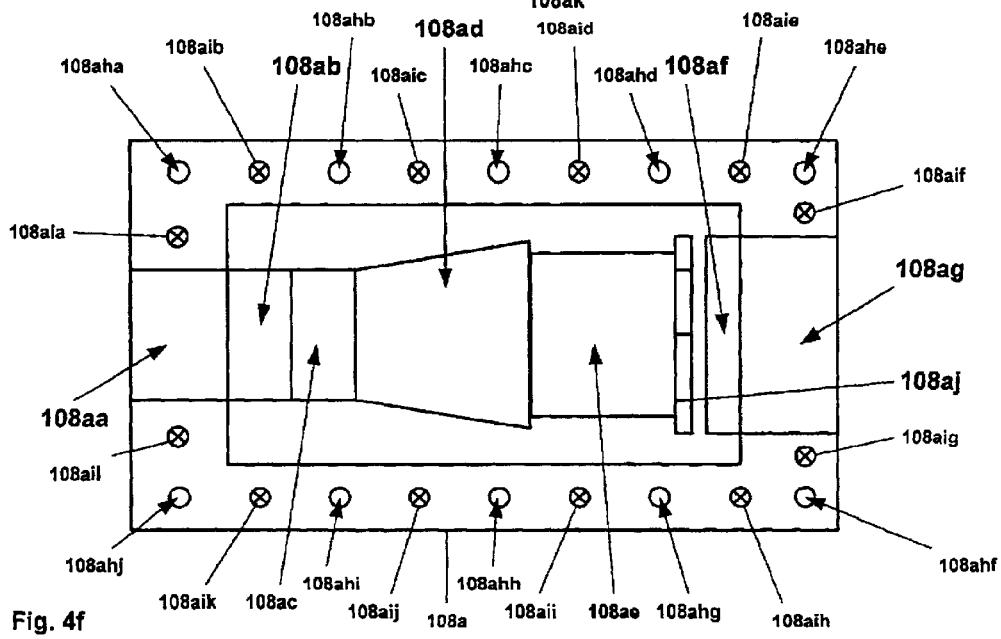
FIG. 4*f* is a top view of the housing of the first bottom crimp and cut clamp of FIG. 4*a*.
Figure 5A:
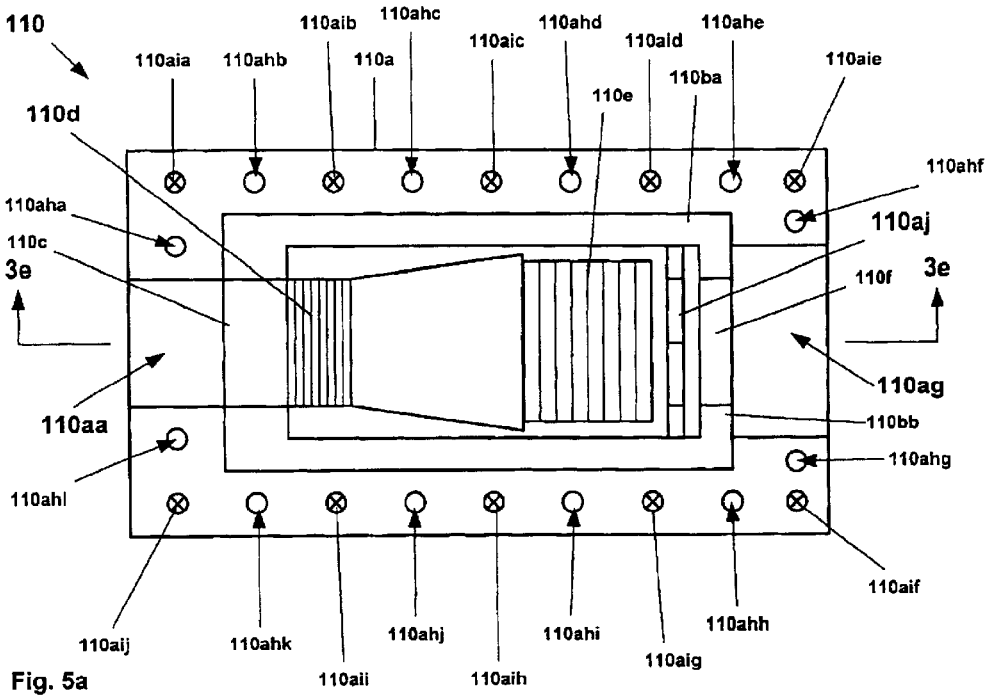
FIG. 5*a* is a top view of an embodiment of the second top crimp and cut clamp of the system of FIG. 2*a*.
Figure 5B:
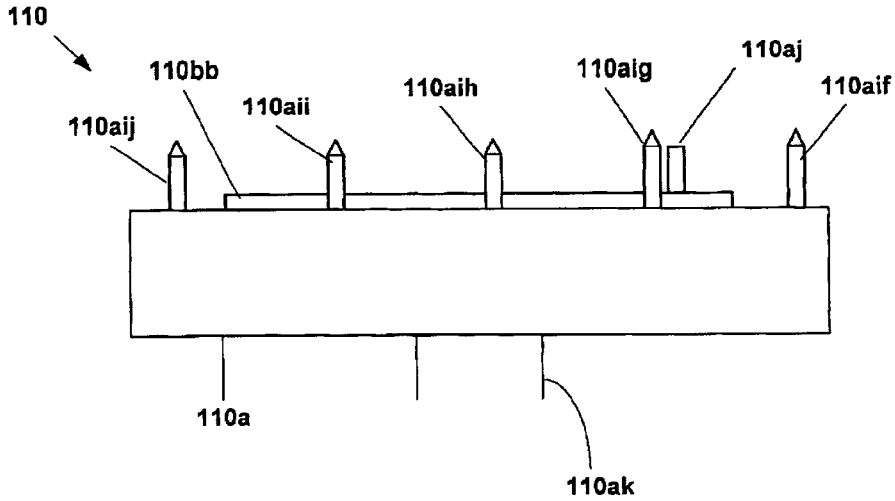
FIG. 5*b* is a side view of the second top crimp and cut clamp of FIG. 5*a*.
Figure 5C:
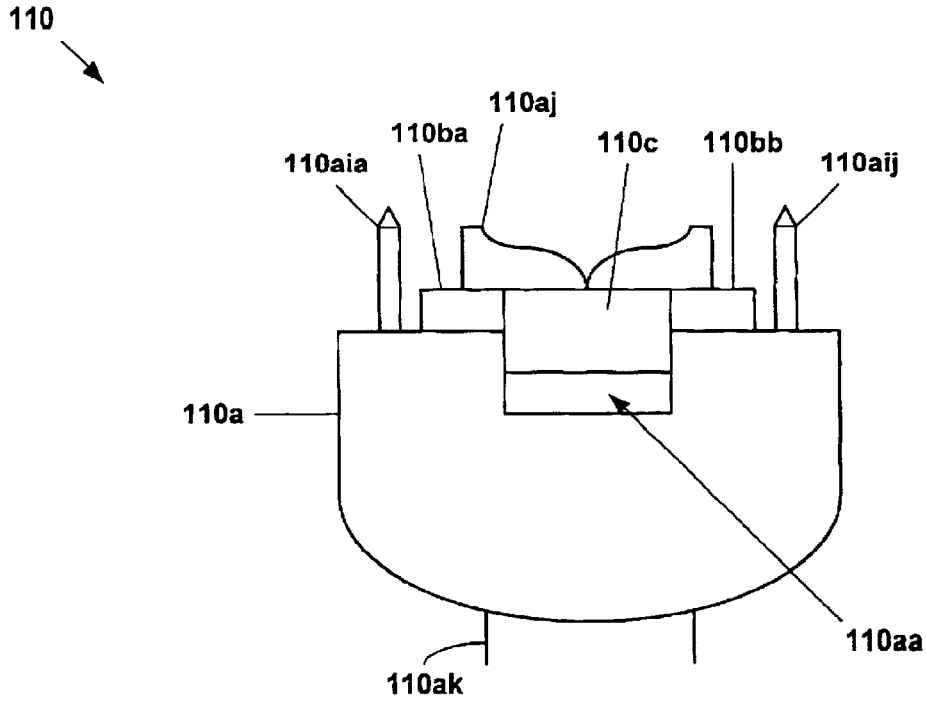
FIG. 5*c* is an end view of the second top crimp and cut clamp of FIG. 5*a*.
Figure 5D:
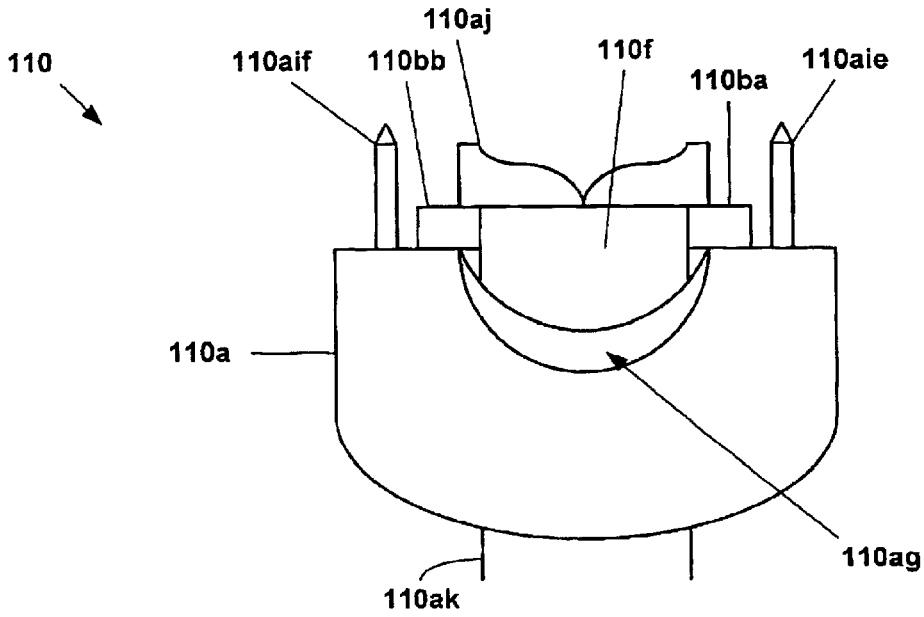
FIG. 5*d* is another end view of the second top crimp and cut clamp of FIG. 5*a*.
Figure 5E:
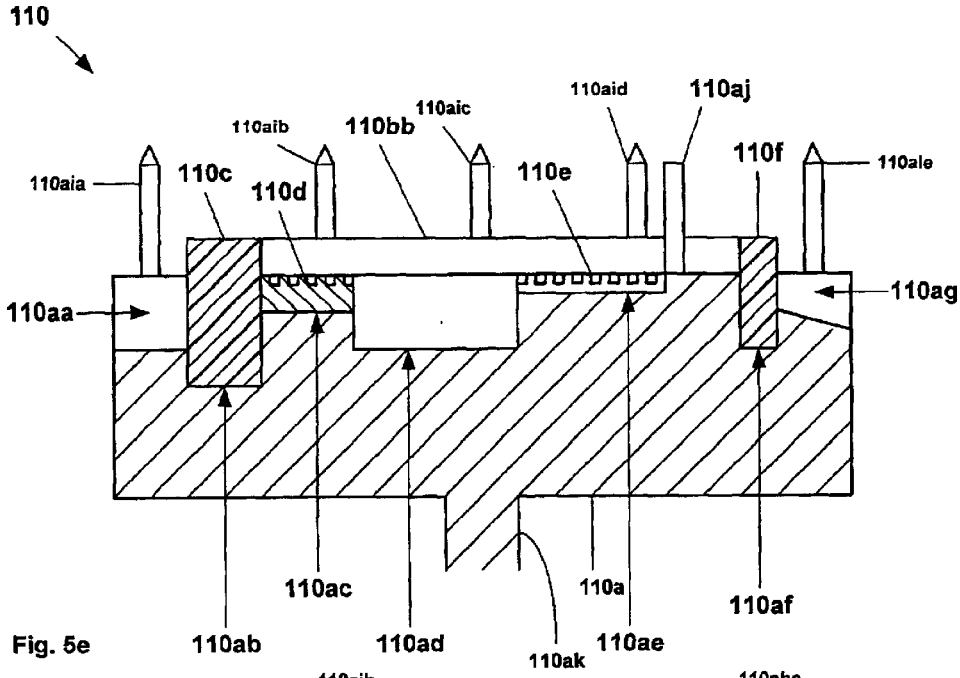
FIG. 5*e* is a cross-sectional view of the second top crimp and cut clamp of FIG. 5*a*.
Figure 5F:
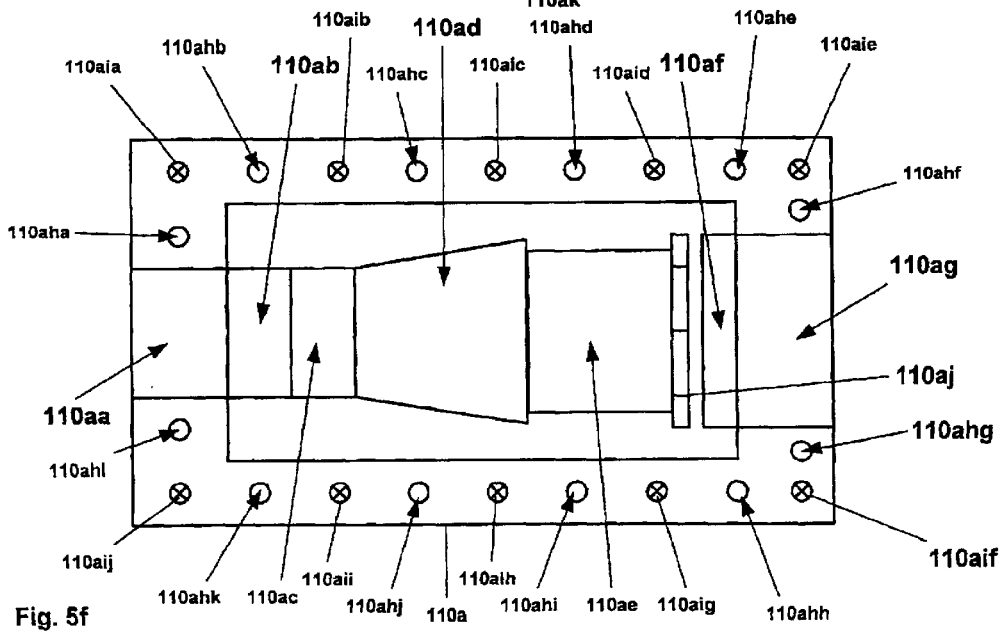
FIG. 5*f* is a top view of the housing of the second top crimp and cut clamp of FIG. 5*a*.
Figure 6A:
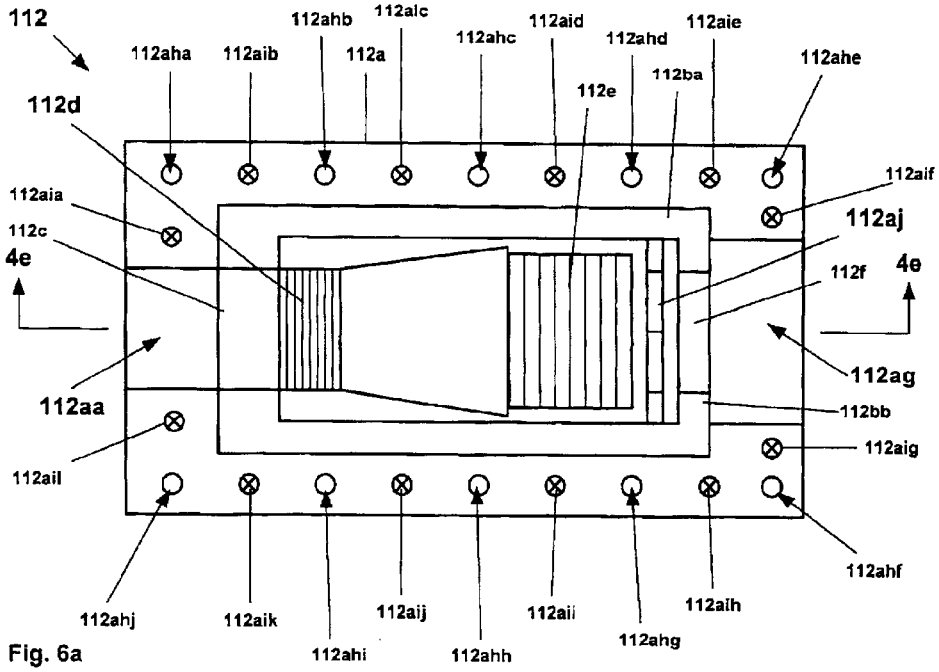
FIG. 6*a* is a top view of an embodiment of the second bottom crimp and cut clamp of the system of FIG. 2*a*.
Figure 6B:
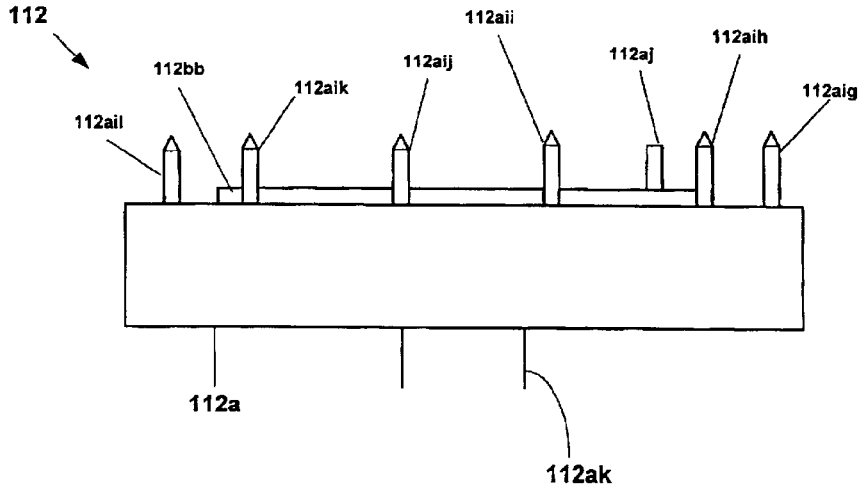
FIG. 6*b* is a side view of the second bottom crimp and cut clamp of FIG. 6*a*.
Figure 6C:
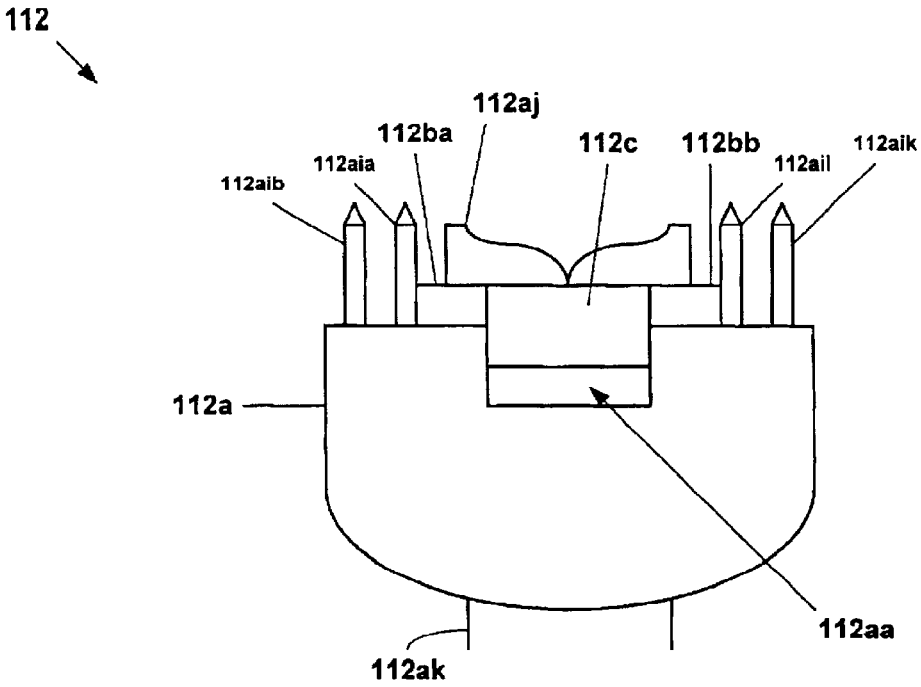
FIG. 6*c* is an end view of the second bottom crimp and cut clamp of FIG. 6*a*.
Figure 6D:
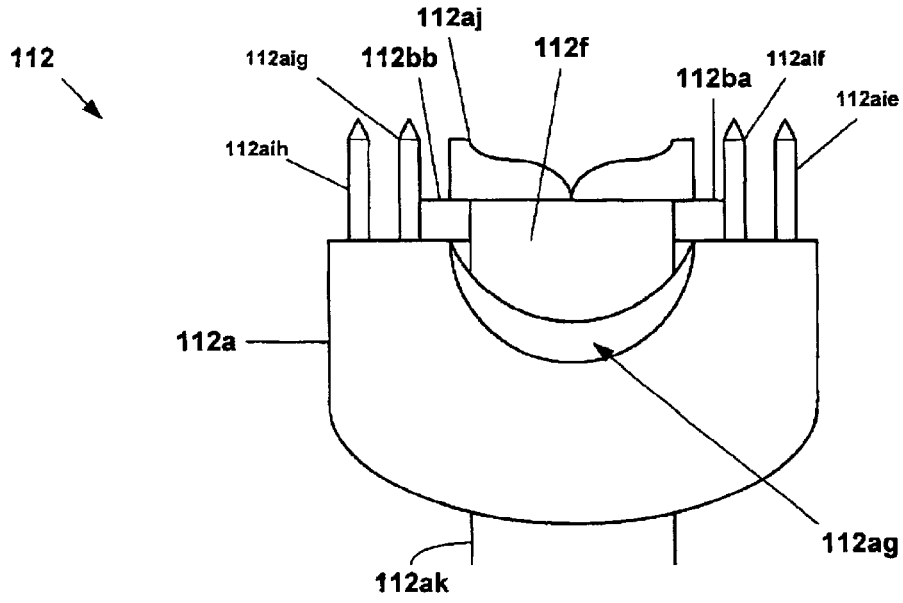
FIG. 6*d* is another end view of the second bottom crimp and cut clamp of FIG. 6*a*.
Figure 6E:
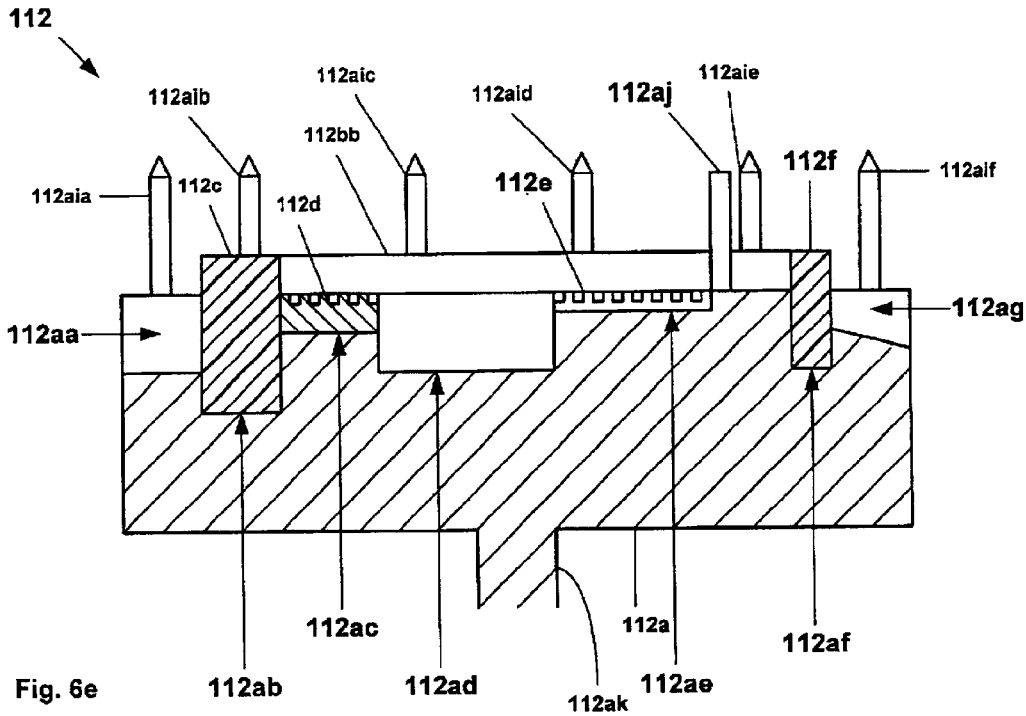
FIG. 6*e* is a cross-sectional view of the second bottom crimp and cut clamp of FIG. 6*a*.
Figure 6F:
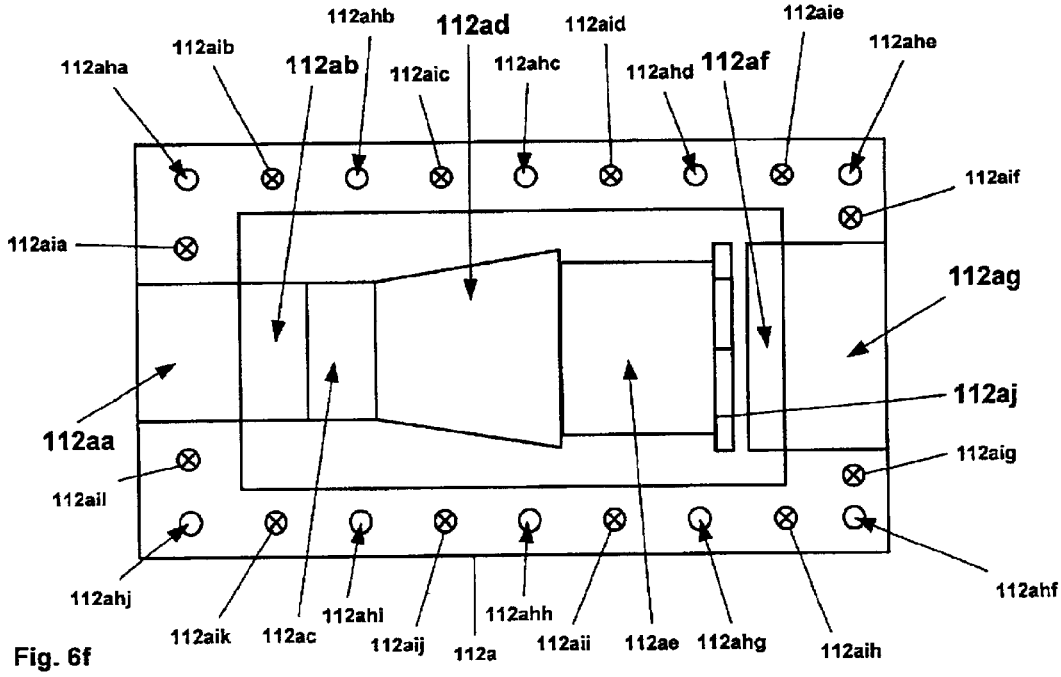
FIG. 6*f* is a top view of the housing of the second bottom crimp and cut clamp of FIG. 6*a*.

As illustrated in FIGS. 2*d* and 2*e*, the other end 104*b* of the coiled tubing 104 may then be released from the housing 102, and off of the offshore platform 103. Because the floatation device 114 is retained on the other end 104*b* of the coiled tubing 104 by the crimped and cut end 104*ba*, the other end 104*b* of the coiled tubing 104 floats upon the surface of the water 124 adjacent to the offshore platform 103. In this manner, the other end 104*b* of the coiled tubing 104 may be retrieved from the water 124. Furthermore, because the end 104*a* of the coiled tubing 104 is sealed off by the crimped and cut end 104*ba*, pressurized, and possibly flammable and/or toxic, fluidic materials are not released to the atmosphere or sprayed on the equipment and personnel on the offshore platform 103.

Thus, the system 100 provides a safe and highly efficient system for disconnecting coiled tubing 104. As a result, in the event of an emergency situation such as, for example, a blow out, the end 104*a* of the coiled tubing 104 may be quickly and safely disconnected from the other end 104*b* of the coiled tubing thereby preventing damage to the remaining portion of the offshore platform 103. Furthermore, since both ends, 104*a* and 104*b*, of the coiled tubing 104 are sealed off by the cutting and crimping operation, pressurized, and possibly flammable and/or toxic, fluidic materials within the ends of the coiled tubing 104 are not released to the atmosphere or sprayed on equipment or personnel on the offshore platform 103.

Figure 7A:
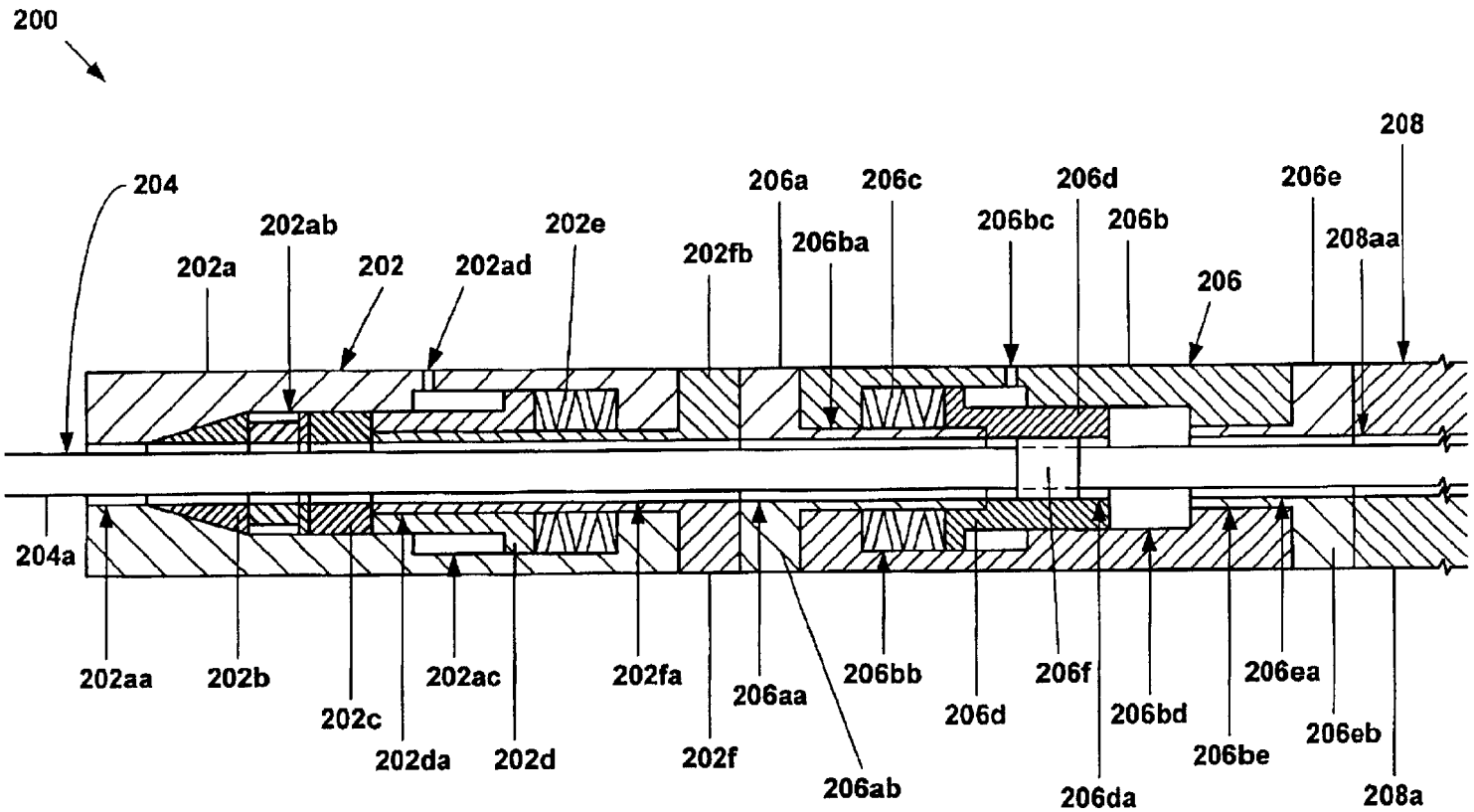
FIGS. 7*a*–7*c* are illustrations of another embodiment of a disconnect system for coiled tubing.
Figure 7B:
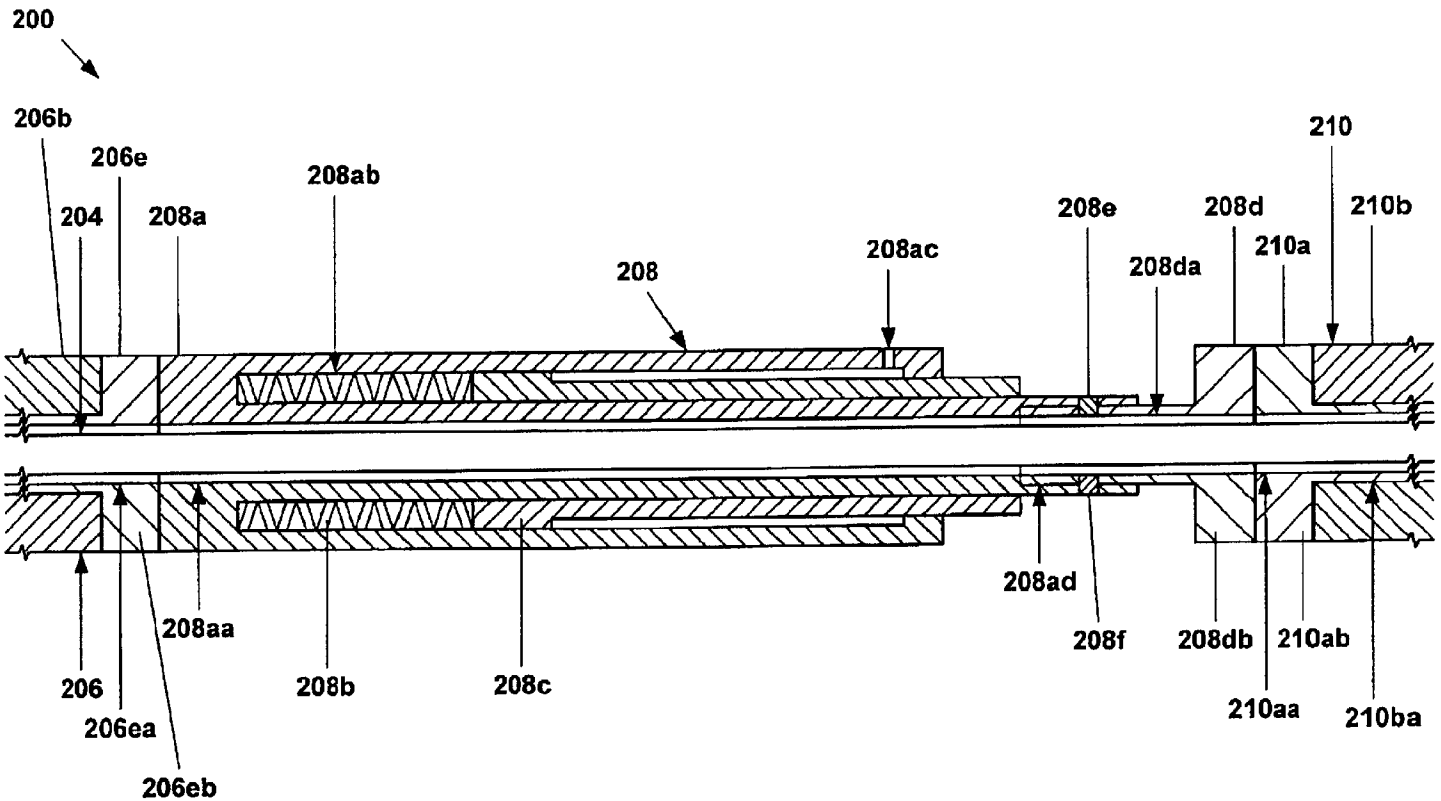
Figure 7C:
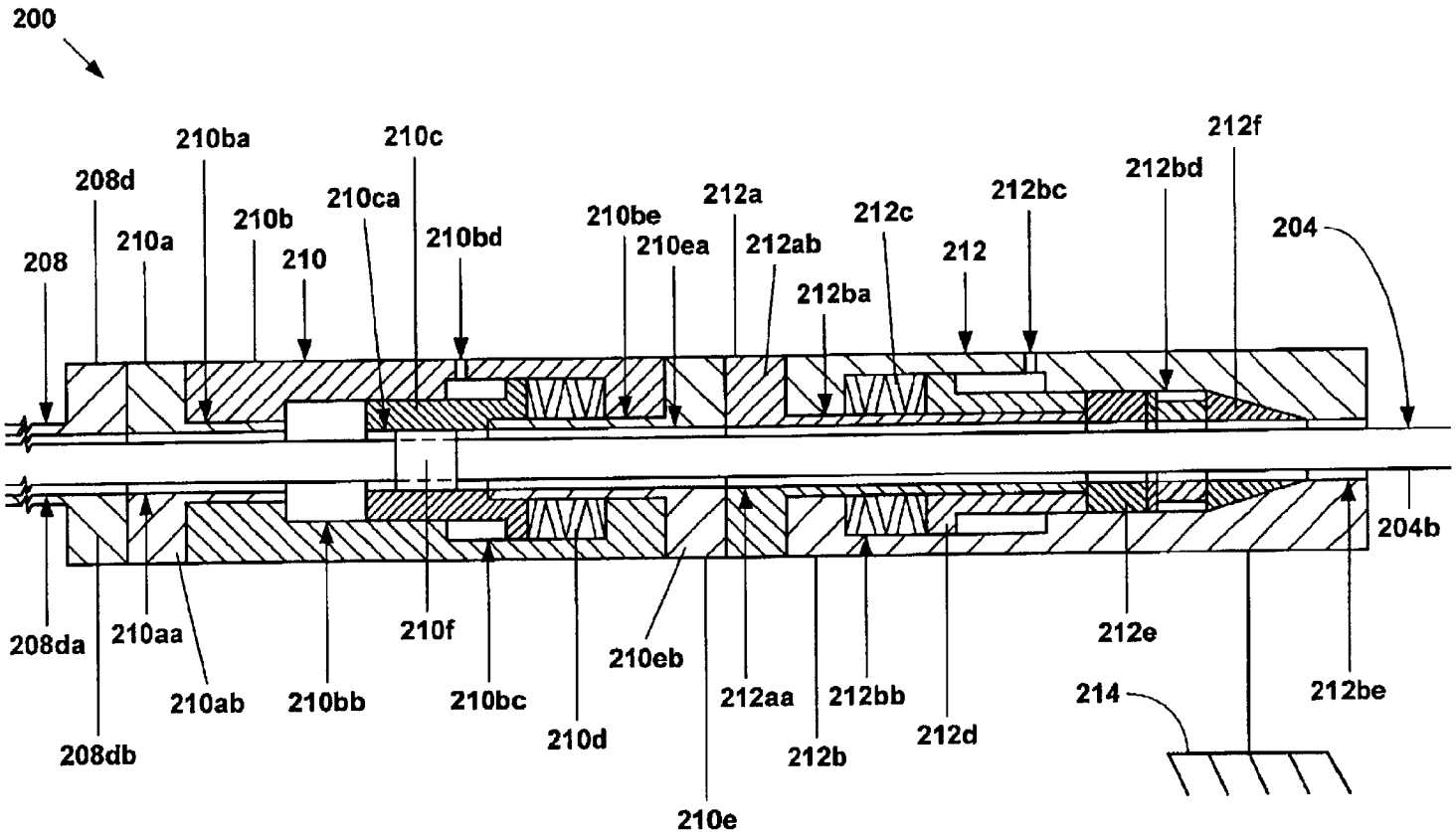

Referring to FIG. 7*a*, the reference numeral 200 refers, in general, to another embodiment of a disconnect system for coiled tubing that includes a conventional pack off assembly 202 that includes a housing 202*a* that defines a passage 202*aa* for receiving coiled tubing 204, an annular chamber 202*ab* for receiving tubular slips 202*b*, a tubular pack off 202*c*, and an end of a tubular piston 202*d* that defines a passage 202*da*, an annular piston chamber 202*ac* for receiving another end of the tubular piston 202*d* and a spring element 202*e*, and a radial passage 202*ad* for controllably pressurizing the annular piston chamber 202*ac*. A tubular sleeve 202*f* that defines a passage 202*fa* for receiving the coiled tubing 204 is received within the passage 202*da* of the tubular piston 202*d* that includes a flange 202*fb* that is coupled to an end of the housing 202*a*. In an exemplary embodiment, the pack off assembly 202 is a conventional pack off assembly commercially available from Halliburton Energy Services, Inc.

A conventional tubing cutter valve assembly 206 is coupled to the conventional pack off assembly 202 that includes a tubular sleeve 206*a* that defines a passage 206*aa* for receiving the coiled tubing 204 and a flange 206*ab* that is coupled to the flange 202*fb* of the tubular sleeve 202*f*. An end of a housing 206*b* that defines a passage 206*ba* for receiving an end of the tubular sleeve 202*f*, an annular piston chamber 206*bb* for receiving a spring element 206*c*, and an end of a tubular piston 206*d* that defines a passage 206*da* for receiving the coiled tubing 204, a radial passage 206*bc* for pressurizing the annular piston chamber 206*bb*, an annular chamber 206*bd* for receiving another end of the tubular piston 206*d*, and a passage 206*be* for receiving an end of a tubular sleeve 206*e* that defines a passage 206*ea* for receiving the coiled tubing 204 and includes a flange 206*eb* is coupled to the tubular sleeve 206*a*, and the other end of the housing 206*b* is coupled to the tubular sleeve 206*e*. A conventional cutter valve 206*f* is operably coupled to the tubular piston 206*d* for controllably cutting the coiled tubing 204 in a conventional manner. In an exemplary embodiment, the tubing cutter valve assembly 206 is a conventional Super Cutter™ Valve commercially available from Halliburton Energy Services, Inc.

A separator assembly 208 is coupled to the tubing cutter valve assembly 206 that includes a housing 208*a* that defines a passage 208*aa* for receiving the coiled tubing 204, an annular piston chamber 208*ab* for receiving a spring element 208*b* and a tubular piston 208*c*, a radial passage 208*ac* for pressurizing the annular piston chamber 208*ab*, and a passage 208*ad* for receiving an end of a tubular sleeve 208*d* defining a passage 208*da* for receiving the coiled tubing 204 and a flange 208*db* that is coupled to the tubular sleeve 206*e* of the tubing cutter valve assembly 206. Shear pins, 208*e* and 208*f*, releasably couple the other end of the housing 208*a* and the tubular sleeve 208*d*.

A conventional tubing cutter valve assembly 210 is coupled to the separator assembly 208 that includes a tubular sleeve 210*a* that defines a passage 210*aa* for receiving the coiled tubing 204 and a flange 210*ab* that is coupled to the flange 208*db* of the tubular sleeve 208*d* of the separator assembly 208. An end of a housing 210*b* that defines a passage 210*ba* for receiving an end of the tubular sleeve 210*a*, an annular chamber 210*bb* for receiving an end of a tubular piston 210*c* that defines a passage 210*ca* for receiving the coiled tubing 204, an annular piston chamber 210*bc* for receiving another end of the tubular piston 210*c* and a spring element 210*d*, a radial passage 210*bd* for pressurizing the annular piston chamber 210*bc*, and a passage 210*be* for receiving an end of a tubular sleeve 210*e* that defines a passage 210*ea* for receiving the coiled tubing 204 and includes a flange 210*eb* is coupled to the tubular sleeve 210*a*, and the other end of the housing 210*b* is coupled to the tubular sleeve 210*e*. A conventional cutter valve 210*f* is operably coupled to the tubular piston 210*c* for controllably cutting the coiled tubing 204 in a conventional manner. In an exemplary embodiment, the tubing cutter valve assembly 210 is a conventional Super Cutter™ Valve commercially available from Halliburton Energy Services, Inc.

A conventional pack off assembly 212 is coupled to the conventional tubing cutter valve assembly 210 that includes a tubular sleeve 212*a* that defines a passage 212*aa* for receiving the coiled tubing 204 and a flange 212*ab* that is coupled to the flange 210*eb* of the tubular sleeve 210*e* of the tubing cutter valve assembly 210. A housing 212*b* that defines a passage 212*ba* for receiving an end of the tubular sleeve 212*a*, an annular piston chamber 212*bb* for receiving a spring element 212*c* and an end of a tubular piston 212*d*, a radial passage 212*bc* for pressurizing the annular piston chamber 212*bb*, an annular chamber 212*bd* for receiving another end of the tubular piston 212*d*, a tubular pack off 212*e* and a tubular slip 212*f*, and a passage 212*be* for receiving the coiled tubing 204 is coupled to the tubular sleeve 212*a*. In an exemplary embodiment, the pack off assembly 212 is a conventional pack off assembly commercially available from Halliburton Energy Services, Inc. In an exemplary embodiment, the pack off assembly 212 is coupled to an offshore platform 214 such as, for example, the deck of a floating offshore vessel.

An end 204*a* of the coiled tubing 204 extends out of the passage 202*aa* of the housing 202*a* of the pack off assembly 202 into a conventional undersea wellbore below the surface of the water, and the other end 204*b* of the coiled tubing 204 extends out of the passage 212*be* of the housing 212*b* of the pack off assembly 212 to a conventional reel of coiled tubing. In this manner, the coiled tubing 204 may be dispensed off of the reel into the undersea wellbore.

During the initial operation of the system 200, the coiled tubing 204 passes through the passages 202*aa*, 202*fa*, 206*aa*, 206*da*, 206*ea*, 208*aa*, 208*da*, 210*aa*, 210*ca*, 210*ea*, 212*aa*, and 212*be*. The end 204*a* of the coiled tubing 204 may be wound about a conventional coiled tubing reel, and the other end 204*b* of the coiled tubing 204 may be positioned in an undersea well using a conventional coiled tubing injector. During the initial operation of the system 200, a pressurized fluid is injected into the annular piston chambers, 202*ac*, 206*bb*, 208*ab*, 210*bc*, and 212*bb* through the radial passages, 202*ad*, 206*bc*, 208*ac*, 210*bd*, and 212*bc*, respectively, at a predetermined operating pressure using a pump to thereby compress the spring elements, 202*e*, 206*c*, 208*b*, 210*d*, and 212*c*, respectively. In this manner, the coiled tubing 204 is free to pass through the passages 202*aa*, 202*fa*, 206*aa*, 206*da*, 206*ea*, 208*aa*, 208*da*, 210*aa*, 210*ca*, 210*ea*, 212*aa*, and 212*be*.

In order to disconnect the end 204*a* of the coiled tubing 204 from the other end 204*b* of the coiled tubing 204, the hydraulic pressure of the pressurized fluid in the annular piston chambers, 202*ac*, 206*bb*, 208*ab*, 210*bc*, and 212*bb* is controllably reduced. In this manner, the spring elements, 202*e*, 206*c*, 208*b*, 210*d*, and 212*c*, may then displace the tubular pistons, 202*d*, 206*d*, 208*c*, 210*c*, and 212*d*, respectively, in a longitudinal direction away from the spring elements, 202*e*, 206*c*, 208*b*, 210*d*, and 212*c*, and thereby operate the pack off assemblies, 202 and 212, the tubing cutter valve assemblies, 206 and 210, and the separator assembly 208.

In an exemplary embodiment, the pack off assemblies, 202 and 212, are operated before the tubing cutter valve assemblies, 206 and 210, and the separator assembly 208, and the tubing cutter valve assemblies, 206 and 210, are operated before the separator assembly 208. In particular, in an exemplary embodiment, the tubular slips, 202*b* and 212*f*, and tubular pack offs, 202*c* and 212*e*, of the pack off assemblies, 202 and 212, respectively, are actuated by the displacement of the tubular pistons, 202*d* and 212*d*, and thereby engage the corresponding sections of the coiled tubing 204 and maintain the corresponding sections of the coiled tubing 204 in a stationary position. The cutter valves, 206*f* and 210*f*, of the tubing cutter valve assemblies, 206 and 210, respectively, are then actuated by the displacement of the tubular pistons, 206*d* and 210*c*, and thereby shear and crimp the ends of the corresponding sections of the coiled tubing 204. As a result, the coiled tubing 204 is divided up into three sections. Finally, the tubular piston 208*c* of the separator assembly 208 is displaced thereby shearing the shear pins, 208*e* and 208*f*, and displacing the tubular sleeve 208*d* away from the end of the housing 208*a*. As a result, the ends, 204*a* and 204*b*, of the coiled tubing 204 are separated by holding the ends of the coiled tubing 204 using the pack off assemblies, 202 and 212, shearing the coiled tubing 204 using the tubing cutter valve assemblies, 206 and 210, and then separating the ends of the coiled tubing 204 using the separator assembly 208.

Thus, the system 200 provides a safe and highly efficient system for disconnecting coiled tubing. As a result, in the event of an emergency situation such as, for example, a blow out, the end 204*a* of the coiled tubing 204 may be quickly and safely disconnected from the other end 204*b* of the coiled tubing 204 thereby preventing damage to the remaining portion of the offshore platform 214. Furthermore, since the ends of the coiled tubing 204 are sealed off by the cutting and crimping operations, pressurized, and possibly flammable and/or toxic, fluidic materials within the ends of the coiled tubing 204 are not released to the atmosphere or sprayed on equipment or personnel on the offshore platform 214.

It is understood that variations may be made in the foregoing without departing from the scope of the invention. For example, while the present systems have been described for use on an offshore platform, the teachings of the present embodiments may be applied to land-based oil and gas wells, as well as any application in which it is desirable to disconnect one end of a tubing from another end of a tubing. Furthermore, the offshore platform may be a stationary or a floating structure, and may be located on any body of water.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. A method of disconnecting one end of a tubing from another end of the tubing, comprising:

holding the tubing in a stationary position at a first location and a second location;

shearing the tubing at one or more locations between and apart the first location and the second location to form at least a first section of tubing and a second section of tubing; and moving the first section of tubing away from the second section of tubing.

2. The method of claim 1, further comprising:

isolating the first section of tubing from the second section of tubing.

3. The method of claim 1, further comprising:

releasing pressurized fluidic materials from the first section of tubing.

4. The method of claim 1, further comprising:

releasing the first section of tubing.

5. The method of claim 4, further comprising:

floating an end of the first section of tubing upon the surface of a body of water.

6. The method of claim 1, further comprising:

shearing the tubing at a plurality of locations between the first and second location.

7. The method of claim 6, further comprising:

crimping the tubing at the plurality of locations between the first and second location.

8. A system for disconnecting one end of a tubing from another end of the tubing, comprising:

means for holding the tubing in a stationary position at a first location and a second location;

means for shearing the tubing at one or more locations between the first location and the second location to form at least a first section of tubing and a second section of tubing; and means for releasing pressurized fluidic materials from at least one of the first section of tubing and the second section of tubing.

9. The system of claim 8, further comprising:

means for moving the first section of tubing away from the second section of tubing.

10. The system of claim 8, further comprising:

means for isolating the first section of tubing from the second section of tubing.

11. The system of claim 8, further comprising:

means for releasing pressurized fluidic materials from the first section of tubing.

12. The system of claim 8, further comprising:

means for releasing the first section of tubing.

13. The system of claim 12, further comprising:

means for floating an end of the first section of tubing upon the surface of a body of water.

14. The system of claim 8, further comprising:

means for shearing the tubing at a plurality of locations between the first and second location.

15. The system of claim 14, further comprising:

means for crimping the tubing at the plurality of locations between the first and second location.

16. A system for disconnecting one end of a tubing from another end of the tubing, comprising:

a first holding device for holding the tubing at a first location;

a second holding device coupled to the first holding device for holding the tubing at a second location;

at least one shearing device coupled to the first and second holding devices for shearing the tubing at a location between and apart from the first and second locations to form at least a first and a second section of tubing; and an actuator device for moving the first section of tubing away from the second section of tubing.

17. The system of claim 16, wherein:

the actuator device is coupled to the first and second holding devices.

18. The system of claim 17, wherein the actuator device comprises:

an inner sleeve defining a passage for receiving the tubing and comprising a flange coupled to the first holding device;

an outer sleeve defining a passage for receiving the inner comprising a flange coupled to the second holding device;

one or more actuators for displacing the flanges of the inner and outer sleeves away from one another; and one or more shear pins for releasably coupling the inner and outer sleeves.

19. The system of claim 18, wherein the outer sleeve further defines one or more radial passages for venting pressurized fluidic materials from the tubing.

20. The system of claim 18, wherein the outer sleeve defines an annular piston chamber and a radial passage for pressurizing the annular piston chamber; and wherein the actuator comprises:

a spring element received within the annular piston chamber; and a tubular piston received within the annular piston chamber.

21. The system of claim 16, further comprising:

an isolator device coupled to the first and second holding devices for isolating the first and second sections of tubing.

22. The system of claim 16, wherein the first holding device is adapted to release the first section of tubing.

23. The system of claim 16, wherein the shearing device comprises:

a plurality of shearing devices for shearing the tubing at a plurality of locations between the first and second location.

24. The system of claim 23, wherein each of the shearing devices are adapted to crimp the tubing.

25. The system of claim 16, further comprising:

a floatation device for floating an end of the first section of tubing upon the surface of a body of water.

26. A method of disconnecting one end of a coiled tubing from another end of the coiled tubing on an offshore platform, comprising:

holding the tubing on the offshore platform in a stationary position at a first location and a second location;

shearing the tubing on the offshore platform at a location between the first location and the second location to form a first section of tubing and a second section of tubing;

moving the first section of tubing away from the second section of tubing;

isolating the first section of tubing from the second section of tubing;

releasing pressurized fluidic materials from the first section of tubing; and releasing the first section of tubing off of the offshore platform.

27. A system for disconnecting one end of a coiled tubing from another end of the coiled tubing on an offshore platform, comprising:

means for holding the tubing on the offshore platform in a stationary position at a first location and a second location;

means for shearing the tubing on the offshore platform at a location between the first location and the second location to form a first section of tubing and a second section of tubing;

means for moving the first section of tubing away from the second section of tubing;

means for isolating the first section of tubing from the second section of tubing;

means for releasing pressurized fluidic materials from the first section of tubing; and means for releasing the first section of tubing off of the offshore platform.

28. A system for disconnecting one end of a coiled tubing from another end of the coiled tubing, comprising:

a first pipe ram assembly comprising:

a first pipe ram housing defining a passage for receiving the tubing; and a first pipe ram movably coupled to the pipe ram housing for controllably engaging the tubing within the passage;

a first slip ram assembly coupled to the first pipe ram assembly comprising:

a first slip ram housing defining a passage for receiving the tubing; and a first slip ram movably coupled to the slip ram housing for controllably engaging the tubing with the passage;

an hydraulic jack assembly coupled to the first slip ram assembly comprising:

an inner tubular member defining a passage for receiving the tubing and comprising a flange at one end;

an outer tubular member defining one or more radial passages for receiving the inner tubular member and comprising a flange at one end;

one or more shear pins coupled between the inner and outer tubular member; and one or more hydraulic jacks coupled between the inner and outer tubular member for controllably displacing the flanges;

a blind ram assembly coupled to the offshore platform and the hydraulic jack assembly comprising:

a blind ram housing defining a passage for receiving the tubing; and a blind ram movably coupled to the blind ram housing for controllably sealing off the passage;

a shear ram assembly coupled to the offshore platform and the blind ram assembly comprising:

a shear ram housing defining a shear ram passage for receiving the tubing; and a shear ram movably coupled to the shear ram housing for controllably shearing the tubing;

a second pipe ram assembly coupled to the offshore platform and the shear ram assembly comprising:

a pipe ram housing defining a passage for receiving the tubing; and a pipe ram movably coupled to the pipe ram housing for controllably engaging the tubing within the passage; and a second slip ram assembly coupled to the offshore platform and the second pipe ram assembly comprising:

a slip ram housing defining a passage for receiving the tubing; and a slip ram movably coupled to the slip ram housing for controllably engaging the tubing with the passage.

29. A method of disconnecting one end of a coiled tubing from another end of the coiled tubing on an offshore platform, comprising:

shearing and crimping the tubing on the offshore platform at a first location and a second location to form a first, a second, and a third section of tubing;

restraining the movement of the first section of tubing on the offshore platform;

releasing the third section of tubing from the offshore platform; and floating the third section of tubing upon the surface of a body of water.

30. A system for disconnecting one end of a coiled tubing from another end of coiled tubing on an offshore platform, comprising:

means for shearing and crimping the tubing on the offshore platform at a first location and a second location to form a first, a second, and a third section of tubing;

means for restraining the movement of the first section of tubing on the offshore platform;

means for releasing the third section of tubing from the offshore platform; and means for floating the third section of tubing upon the surface of a body of water.

31. A system for disconnecting one end of a coiled tubing from another end of the coiled tubing on an offshore platform, comprising:

a housing defining a first passage, a first chamber, a second passage, a second chamber, and a third passage for receiving the tubing coupled to the offshore platform, wherein the third passage is larger than the first and second passages;

a first crimp and cut assembly comprising:

a first upper crimp and cut clamp and a first lower crimp and cut clamp movably supported within the first chamber for cooperatively crimping and cutting the tubing within the first chamber; and a second crimp and cut assembly comprising:

a second upper crimp and cut clamp and a second lower crimp and cut clamp movably support within the second chamber for cooperatively crimping and cutting the tubing within the second chamber; and a floatation device defining a fourth passage for receiving the tubing movably coupled to the housing, wherein the fourth passage is smaller than the third passage.

32. A method of disconnecting one end of a coiled tubing from another end of the coiled tubing on an offshore platform, comprising:

holding the tubing in a stationary position on the offshore platform at a first location and a second location;

shearing the tubing on the offshore platform at a plurality of locations between the first location and the second location to form a first section of tubing, a second section of tubing, and a third section of tubing; and moving the first section of tubing away from the third section of tubing on the offshore platform.

33. A system for disconnecting one end of a coiled tubing from another end of the coiled tubing on an offshore platform comprising:

means for holding the tubing in a stationary position on the offshore platform at a first location and a second location;

means for shearing the tubing on the offshore platform at a plurality of locations between the first location and the second location to form a first section of tubing, a second section of tubing, and a third section of tubing; and means for moving the first section of tubing away from the third section of tubing on the offshore platform.

34. A system for disconnecting one end of a coiled tubing from another end of the coiled tubing on an offshore platform, comprising:

a first packoff assembly defining a first passage for receiving the tubing comprising:

a packer and a slip for engaging the tubing within the first passage; and an actuator for controlling the operation of the packer and the slip;

a first tubing cutter valve assembly coupled to the first packoff assembly defining a second passage for receiving the tubing comprising:

a cutter valve for shearing the tubing within the second passage; and an actuator for controlling the operation of the cutter valve;

a separator assembly coupled to the first tubing cutter assembly comprising:

a housing defining a third passage for receiving the tubing, an annular piston chamber, and a radial passage for pressurizing the annular piston chamber;

a spring element received within the annular piston chamber;

a tubular piston received within the annular piston chamber;

a tubular member received within the third passage defining a fourth passage for receiving the tubing and comprising a flange; and a shear pin for releasably coupling the tubular member and the housing;

a second tubing cutter valve assembly coupled to the offshore platform and the separator assembly defining a fifth passage for receiving the tubing comprising:

a cutter valve for shearing the tubing within the fifth passage; and an actuator for controlling the operation of the cutter valve; and a second packoff assembly coupled to the offshore platform and the second tubing cutter valve assembly defining a sixth passage for receiving the tubing comprising:

a packer and a second slip for engaging the tubing within the sixth passage; and an actuator for controlling the operation of the packer and the slip.

* * * * *